US007687216B2

(12) United States Patent
Kataoka et al.

(10) Patent No.: US 7,687,216 B2
(45) Date of Patent: Mar. 30, 2010

(54) TWO-COMPONENT DEVELOPER AND TWO-COMPONENT DEVELOPING APPARATUS USING THE SAME

(75) Inventors: Toshiharu Kataoka, Higashiosaka (JP); Masahiro Sakai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 535 days.

(21) Appl. No.: 11/154,589

(22) Filed: Jun. 17, 2005

(65) Prior Publication Data

US 2005/0282078 A1 Dec. 22, 2005

(30) Foreign Application Priority Data

Jun. 18, 2004 (JP) ..... 2004-181663

(51) Int. Cl.
*G03G 9/113* (2006.01)

(52) U.S. Cl. ..... 430/111.32; 430/111.35; 430/111.4

(58) Field of Classification Search ..... 430/111.32, 430/111.35, 111.4, 111.1
See application file for complete search history.

(56) References Cited

U.S. PATENT DOCUMENTS

| | | | | |
|---|---|---|---|---|
| 2,297,691 | A | 10/1942 | Cariton | |
| 3,666,363 | A | 5/1972 | Tamaka et al. | |
| 4,686,935 | A * | 8/1987 | Matsui et al. | 399/236 |
| 4,970,557 | A * | 11/1990 | Masuda et al. | 399/43 |
| 5,262,471 | A * | 11/1993 | Akao | 524/496 |
| 5,283,615 | A * | 2/1994 | Yokoyama et al. | 399/231 |
| 5,409,794 | A * | 4/1995 | Ong | 430/108.3 |
| 5,705,306 | A * | 1/1998 | Kitani et al. | 430/108.22 |
| 5,932,387 | A * | 8/1999 | Yamamoto et al. | 430/111.1 |
| 6,210,850 | B1 * | 4/2001 | Ogata et al. | 430/111.1 |
| 6,539,192 | B2 * | 3/2003 | Hibino | 399/267 |
| 7,172,846 | B2 * | 2/2007 | Yamashita et al. | 430/111.33 |
| 2003/0129518 | A1 * | 7/2003 | Sawada et al. | 430/109.4 |
| 2004/0197691 | A1 * | 10/2004 | Moriyama et al. | 430/108.4 |

FOREIGN PATENT DOCUMENTS

| | | | |
|---|---|---|---|
| EP | 1 207 433 | A2 | 5/2002 |
| EP | 1 260 874 | A1 | 11/2002 |
| EP | 1 343 053 | A1 | 10/2003 |
| GB | 1165407 | | 10/1969 |
| JP | 42-23910 | | 11/1967 |
| JP | 43-24748 | | 10/1968 |
| JP | 58-108548 | A | 6/1983 |
| JP | 58-108549 | A | 6/1983 |
| JP | 59-166968 | A | 9/1984 |
| JP | 6-202381 | A | 7/1994 |
| JP | 7-77828 | A | 3/1995 |
| JP | 8-305076 | A | 11/1996 |
| JP | 2683624 | B2 | 8/1997 |
| JP | 10-161354 | * | 6/1998 |
| JP | 1-19584 | B2 | 4/1999 |
| JP | 2002-169325 | A | 6/2002 |
| JP | 2002-311635 | A | 10/2002 |
| JP | 2003-255614 | A | 9/2003 |
| JP | 2004-102261 | A | 4/2004 |

OTHER PUBLICATIONS

Grant, R., et al., ed., Grant & Hackh's Chemical Dictionary, fifth edition, McGraw-Hill Book Company, NY (1987), pp. 232 and 349.*

Japanese Patent Office (JPO) machine assisted translation of JP 10-161354 (pub. Jun. 1998).*

* cited by examiner

*Primary Examiner*—Janis L Dote
(74) *Attorney, Agent, or Firm*—Nixon & Vanderhye P.C.

(57) ABSTRACT

A two-component developer is provided in which the reduction of the hot offset occurrence temperature due to detachment of the coating layer, image density insufficiency, image fogging and toner scattering and the like can be suppressed. In the two-component developer including a toner and a carrier, the content of acrylic resin in a coating layer of the carrier is in a range from 5 to 50% by weight based on the total amount of the coating layer, and the dielectric loss (tan δ) is in the range from $4.0\times10^{-3}$ to $15.0\times10^{-3}$. By using the two-component developer, the reduction of the hot offset occurrence temperature in a fixing apparatus can be prevented. Further, image density insufficiency, image fogging and toner scattering and the like can be suppressed, with a result that images having high quality and sufficient image density can be obtained.

7 Claims, 3 Drawing Sheets

TWO-COMPONENT DEVELOPER AND TWO-COMPONENT DEVELOPING APPARATUS USING THE SAME

This application is a new U.S. patent application and claims priority to JP 2004-181663, filed 18 Jun. 2004, the entire content of which is hereby incorporated by reference.

BACKGROUND OF THE INVENTION

1. Field of the Invention

The invention relates to a two-component developer and two-component developing apparatus used for visualizing latent images such as electrostatic latent images in a method for forming images such as electrophotography and electrostatic recording.

2. Description of the Related Art

In electrophotography widely used in image forming apparatuses such as copiers and printers, images are formed in the following manner, utilizing the photoconduction phenomenon with photoconductive materials (e.g., see U.S. Pat. No. 2,297,691, Japanese Examined Patent Publication JP-B2 42-23910 (1967), and Japanese Examined Patent Publication JP-B2 43-24748 (1968)). First, a photosensitive member provided with photosensitive layer containing photoconductive materials is charged with a predetermined potential that may be either positive or negative, and then the charged photosensitive member is exposed to light, corresponding to image information, to form an electrostatic latent image. Then, the formed electrostatic latent images are developed with a developer containing charged microparticles called toner to form a toner image, which is a visible image. The formed toner image is transferred onto a recording material such as a paper sheet as necessary, fixed to the recording material by, for example, heating, pressing, heating and pressing, or exposure to evaporated solvent, so that an image can be obtained.

As the developer used in electrophotography, two types of developers are known, that is, one-component developers, which are made of only toner, and two-component developers, which are made of toner and particles called carriers having magnetism. Among these, the two-component developers are widely used because of, for example, easy control of charging toner. In a two-component developing apparatus in which developing is performed with a two-component developer, the developer is agitated so that toner and carriers are charged with opposite polarities to each other by frictional electrification and supplied onto a developer holding member provided with a magnet therein to form a magnetic brush made of the carriers and the toner, and the magnetic brush is rubbed against the surface of the photosensitive member to develop an electrostatic latent image. Therefore, the carriers in the two-component developer serve to supply charges to the toner by frictional electrification, to convey the toner to the photosensitive member, and the like, and among these, the supply of charges to the toner is particularly important.

In recent years, for an image forming apparatus using electrophotography such as copiers and printers, increasing the speed of image formation and reducing the size are required, regardless of business use or personal use. In order to increase the speed of image formation and reduce the size of the image forming apparatus, it is examined to reduce the size of the developing apparatus by reducing the size of the developer agitating portion and increase of the developing speed. For this reason, for the two-component developers, it is required to charge toner rapidly by frictional electrification with carrier. Furthermore, the image forming apparatus is required to form uniform images over a long time, so that for the two-component developer, it is required that the charging characteristics of the toner and the charging ability of the carrier to the toner are stabilized over a long time.

Furthermore, in order to reduce the size of the developing apparatus, it is effective to reduce the consumption amount of the toner and to reduce the volume of the container of the developer. As the toner, toner in which a colorant or the like is dispersed in a resin having binding properties that is called "binder resin" is used. As a technique for realizing low consumption amount of the toner, it is proposed to improve the coloring ability by increasing the content of the colorant contained in the toner so that an image with a desired image density can be formed with a small amount of the toner. For example, toner in which the concentration of carbon black in the toner is 10% by weight or more is disclosed (e.g., see Japanese Unexamined Patent Publication JP-A 7-77828). However, since carbon black has conductivity, when the concentration of carbon black in the toner is 10% by weight or more, as in the technique disclosed in JP-A 7-77828, the electrical resistance of the toner becomes too low, and the charge amount of the toner becomes too small, so that problems such as image fogging and toner scattering are caused. In order to solve this problem, it is necessary to set the electrical resistance of the carrier to high.

The carrier used in the two-component developer can be classified roughly into coated carrier, which is made of magnetic particles whose surfaces are coated with a coating layer made of, for example, resin, and non-coated carrier, which is made of magnetic particles themselves. Among these, the coated carrier is widely used because of a longer life of the developer and easier control of charging toner than the non-coated carrier. Furthermore, the coated carrier has an advantage that carrier lifting occurs with more difficulty than the non-coated carrier. Herein, "carrier lifting" refers to a phenomenon in which charges having a polarity opposite to that of the charges on the surface of the photosensitive member are introduced to the carrier during development, so that a coulomb force is exerted between the charges on the surface of the photosensitive member and the carrier, and therefore the carrier is attached to the surface of the photosensitive member. When the carrier lifting occurs, the carrier is transferred to a recording material together with the toner, so that critical image defects such as partial transfer defects are caused. It is believed that since the non-coated carrier generally has a lower electrical resistance than that of the coated carrier, the charges with an opposite polarity to the charges on the surface of the photosensitive member tend to be introduced during development, and carrier lifting occurs more easily than in the case of the coated carrier.

Furthermore, since the coated carrier generally has a higher electrical resistance than that of the non-coated carrier as described above, the coated carrier is more effective to solve the problems that are caused when the content of carbon black in the toner is increased. However, when the surface of magnetic particles, which serve as a carrier core material, is coated only with resin, the electrical resistance of the carrier becomes too high, so that the problem that images are degraded because of the edge effect and the phenomenon of accumulation of charges is caused. Herein, the "edge effect" refers to a phenomenon in which when forming an image including a solid image portion with a large area such as a black solid portion, among the solid image portions to which toner is attached, the solid image portion near the boundary with a non-image portion to which toner is not attached is developed with excessive toner, so that the image density in that portion becomes higher than that of the central portion of the solid image portion.

As a technique for solving this problem, it is proposed to disperse conductive particles in the coating layer of the carrier in order to reduce the electrical resistance of the carrier as appropriate and suppress excessive accumulation of charges in the carrier, and to suppress leakage of the charges from the carrier (e.g., see Japanese Unexamined Patent Publication JP-A 58-108549 (1983), Japanese Unexamined Patent Publication JP-A 59-166968 (1984), Japanese Examined Patent Publication JP-B2 1-19584 (1989), and Japanese Unexamined Patent Publication JP-A 6-202381 (1994)).

In this manner, with the coated carrier, desired characteristics can be realized by adding various additives to the coating layer. For example, another conventional technique has proposed to disperse magnetic microparticles in the coating layer in order to prevent the aforementioned carrier lifting (e.g., see Japanese Unexamined Patent Publication JP-A 58-108548 (1983)).

However, in the techniques disclosed in JP-A 58-108549, JP-A59-166968, JP-B21-19584, JP-A6-202381 and JP-A58-108548, the adhesiveness between the coating layer and the carrier core material in the carrier is not taken into consideration, so that the coating layer may be detached and mixed with the toner while agitating the developer. When the coating layer is detached and mixed with the toner, the temperature at which a hot offset phenomenon starts to occur (hereinafter, referred to as "hot offset occurrence temperature) may become lower than the hot offset occurrence temperature when measured only with the toner, depending on the resin constituting the coating layer. Herein, the "hot offset phenomenon" refers to a phenomenon in which when the temperature at which the toner is heated by the fixing member during fixing is too high, the toner melts excessively and is attached to the fixing member.

For example, when resins having a high melting point of, for example, about 250° C. to 350° C. such as silicone resin and fluorocarbon resin (hereinafter, these resins are referred to as "high melting point resins") are used as the resin constituting the coating layer, and the coating layer is detached and the high melting point resin constituting the detached layer is mixed with the toner, then the hot offset occurrence temperature is lowered. The reason seems as follows. Although the toner is heated to about 170° C. to 220° C. by the fixing member during fixing, the high melting point resin mixed with the toner due to the detachment of the coating layer does not melt at the heating temperature of the toner by the fixing member during fixing, because the melting point thereof is as high as about 250 to 350° C. Therefore, it seems that the high melting point resin serves as if a lubricant during fixing and decreases the melt viscosity of the toner, and therefore the hot offset occurrence temperature is lowered.

In particular, a developing apparatus in which the moving direction of the developer holding member in the portion where the photosensitive member and the developer holding member are opposed to each other, which is the position in which electrostatic latent images formed on the photosensitive member are developed is set to the opposite direction to the moving direction of the photosensitive member (hereinafter, referred to as "counter type developing apparatus") is used as developing means, the hot offset occurrence temperature tends to be lowered. This is because in the counter type developing apparatus, the amount of the developer that is compressed per unit time is larger in the opposing portion of the photosensitive member and the developer holding member than that of a developing apparatus in which the moving direction of the developer holding member in the developing position is set to the same direction as the moving direction of the photosensitive member, so that the mechanical load applied to the developer is large and the amount of the coating layer detached becomes large.

When the hot offset occurrence temperature is lowered, the heating temperature of the toner by the fixing member has to be set to a lower temperature than the temperature that is suitable to fix the toner on to a recording material. Therefore, the fixing strength for images is decreased, which is a problem. Thus, for the coated carrier, it is required to improve the adhesiveness between the coating layer and the carrier core material.

A conventional technique regarding improvement of the adhesiveness between the coating layer and the carrier core material has proposed to use a substance in which acrylic resin and melamine resin are crosslinked as the material constituting the coating layer (e.g., see Japanese Patent No. 2683624). However, in the technique disclosed in Japanese Patent No. 2683624, the charging characteristics of the toner are not taken into consideration. Therefore, depending on the charging characteristics of the toner, an appropriate charge amount of the toner cannot be obtained, and image density insufficiency, image fogging and toner scattering may result. In particular, when the size of the particles of the toner is reduced, for example, such a size that the volume average particle diameter is about 6 to 9 μm, in order to meet recent requirements of higher definition and higher quality for images, the specific surface area of the toner increases, and the charging ability of the carrier to the toner becomes insufficient. As a result, the charge amount of the toner is reduced, and image fogging and toner scattering tend to occur.

SUMMARY OF THE INVENTION

An object of the invention is to provide a two-component developer that has excellent adhesiveness between a carrier core and a coating layer of the carrier, can prevent the decrease of the hot offset occurrence temperature due to detachment of the coating layer, allow the toner to be charged in an appropriate charge amount by agitating the toner together with the carrier and suppress image density insufficiency, image fogging and toner scattering, and to provide a two-component developing apparatus using the same.

The invention provides a two-component developer comprising:

a toner containing a binder resin and a colorant; and a carrier having a carrier core material and a coating layer with which the carrier core material is coated, wherein the coating layer of the carrier contains an acrylic resin at 5% by weight or more and 50% by weight or less based on the total amount of the coating layer, and a dielectric loss (tan δ) of the toner is $4.0\times10^{-3}$ or more and $15.0\times10^{-3}$ or less (i.e., $4.0\times10^{-3}\leqq\tan\delta\leqq15.0\times10^{-3}$).

In the invention, it is preferable that the coating layer of the carrier further comprises conductive particles.

In the invention, it is preferable that the coating layer of the carrier further comprises silicone resin.

In the invention, it is preferable that the carrier core material is ferrite particles.

In the invention, it is preferable that the carrier contains 5 parts by weight or more and 20 parts by weight or less of the coating layer with respect to 100 parts by weight of the carrier core material.

In the invention, it is preferable that the carrier has a weight average particle diameter of 50 μm or more and 100 μm or less.

In the invention, it is preferable that the concentration of a colorant in the toner is 10% by weight or more and 15% by weight or less.

In the invention, it is preferable that the concentration of the toner is 3.5% by weight or more and 8.0% by weight or less.

The invention provides a two-component developing apparatus used or developing an latent image formed in a latent image bearing member, comprising:

developer supplying means including a developer holding member that is opposed to the latent image bearing member, for supporting the two-component developer of the invention and conveying the developer to a position in which the latent image formed on the latent image bearing member is to be developed; and control means for controlling an operation of the developer supplying means such that a moving direction of the developer holding member at a position at which a latent image formed on the latent image bearing member is to be developed is opposite to a moving direction of the latent image bearing member at the position.

According to the invention, the two-component developer comprises a toner and a carrier having a carrier layer, wherein the coating layer of the carrier contains an acrylic resin at 5% by weight or more and 50% by weight or less based on the total amount of the coating layer, and the dielectric loss (tan δ) of the toner is $4.0\times10^{-3}$ or more and $15.0\times10^{-3}$ or less ($4.0\times10^{-3}\leqq\tan\delta\leqq15.0\times10^{-3}$). The acrylic resin has better adhesiveness to the carrier core material than, for example, silicone resin, so that when the coating layer contains an acrylic resin at 5% by weight or more based on the total amount of the coating layer, a carrier having excellent adhesiveness between the carrier core material and the coating layer can be realized, and the coating layer is prevented from being detached from the carrier core material during agitation. Furthermore, the softening point of the acrylic resin contained in the coating layer is lower than the melting point of silicone resin, so that the acrylic resin can be melted immediately at a temperature at which the toner is heated by the fixing member during fixing, for example, at about 170 to 220° C., and thus serves as a parting agent. Therefore, even if the coating layer is detached from the carrier core material and mixed with the toner, the hot offset phenomenon hardly occurs. Therefore, even if a resin having a high melting point of about 250 to 350° C. (hereinafter, referred to as "high melting point resin") such as silicone resin is used together with the acrylic resin, as a resin constituting the coating layer, there may be no possibility that the hot offset occurrence temperature is reduced. Thus, in the two-component developer of the invention, a reduction in hot offset occurrence temperature due to detachment of the coating layer of the carrier can be prevented. In the invention, the melting point of a resin refers to a temperature at which a resin exhibiting such thermal properties that in differential scanning calorimetry (abbreviated as "DSC"), the endothermic peak (hereinafter, "melting peak") corresponding to melting definitely appears in the DSC curve so that the melting point can be specified has started to melt. The softening point of a resin refers to a temperature at which a resin exhibiting such thermal properties that a definite endothermic peak does not appear in the DSC curve so that the melting point cannot be specified has started to melt and flow.

For example, when a resin having excellent insulating properties (hereinafter, referred to as "high insulating resin") such as silicone resin is used together with the acrylic resin, as a resin constituting the coating layer, the electrical resistance of the carrier can be appropriate by selecting the content of the acrylic resin in the coating layer in the above-described range. Thus, degradation in the image quality due to carrier lifting, edge effect and the phenomenon of charge accumulation in the carrier, and image fogging and toner scattering due to insufficient charge amount of the toner can be suppressed.

Furthermore, a toner that can obtain a sufficient charge amount by frictional electrification with the carrier used in the two-component developer of the invention can be realized by selecting the dielectric loss (tan δ) in the above-described range. In other words, the charge amount of the toner can be appropriate by selecting the content of the acrylic resin in the coating layer of the carrier from the above-described range and by selecting the dielectric loss (tan δ) in the above-described range, so that image density insufficiency, image fogging and toner scattering can be suppressed.

Therefore, as described above, by selecting the content of the acrylic resin in the coating layer of the carrier in the above-described range and by selecting the dielectric loss (tan δ) from the above-described range, a two-component developer can be realized in which the adhesiveness between the carrier core material and the coating layer is excellent, a reduction in the hot offset occurrence temperature due to detachment of the coating layer can be prevented, the toner can be changed in a suitable amount by agitating the toner and the carrier, and image density insufficiency, image fogging and toner scattering can be suppressed.

According to the invention, it is preferable that the coating layer of the carrier further comprises conductive particles. The carrier can be provided with suitable conductivity by dispersing the conductive particles in the coating layer of the carrier. Therefore, the carrier functions as a developing electrode, and development is performed in a state in which the developing electrode is very close to the surface of the latent image bearing member such as a photosensitive member on which a latent image to be developed is formed, so that original images can be reproduced faithfully in any portion, even for line portions and large-area solid image portions such as black-solid images. Furthermore, since the phenomenon of charge accumulation in the carrier is further suppressed, the charge amount of the toner can be stabilized over a long period, and it becomes easy to control the concentration of the toner in the developer that is supported by the developer holding member, and thus high quality images without non-uniformity in the images can be formed stably over a long period.

According to the invention, it is preferable that the coating layer of the carrier further comprises silicone resin together with the acrylic resin. When, together with the acrylic resin, the silicone resin is contained in the coating layer of the carrier, the toner is prevented from being melted and attached onto the carrier surface while the developer is agitated, so that the charging characteristics of the carrier are prevented from changing over repeated use. Therefore, the charge amount of the toner can be kept constant over a long period and uniform images can be provided.

According to the invention, it is preferable to use ferrite particles as the carrier core material. The ferrite particles have a small change in the electrical resistance over time, and the electrical resistance is hardly changed even if the ambient condition such as temperature and humidity is changed. Therefore, when the ferrite particles are used as the carrier core material, a change in the charging characteristics of the carrier over time and a change due to variations in the ambient conditions can be suppressed. Therefore, under various ambient conditions, the charge amount of the toner can be kept constant over a long period of time, and high quality images can be formed. Furthermore, the head of a magnetic blush formed by the ferrite particles is soft and therefore applies only a small mechanical load to the latent image bearing member, so that degradation of image quality due to rubbing on the surface of the latent image bearing member can be prevented.

According to the invention, it is preferable that the carrier comprises 5 parts by weight or more and 20 parts by weight or less of the coating layer with respect to 100 parts by weight of the carrier core material. By selecting the ratio of the coating layer in the above-described range, the electrical resistance of the carrier can be appropriate, so that the toner can be provided with a suitable charge amount. Therefore, reduction of image density due to excessive charge amount of the toner, or image fogging and toner scattering due to insufficient charge amount of the toner can be prevented reliably. Since exposure of the carrier core material due to a mechanical load during agitation can be prevented, a change of the charging characteristics of the carrier due to an increase of the exposed portion of the carrier can be suppressed, so that the durability of the two-component developer can be improved.

According to the invention, it is preferable that the carrier has a weight average particle diameter of 50 μm or more and 100 μm or less. By selecting the weight average particle diameter of the carrier in this range, occurrence of the carrier lifting phenomenon can be further suppressed, and occurrence of partial transfer defects in the images can be prevented more reliably. Moreover, the charging ability of the carrier to the toner becomes appropriate, so that the toner can be provided with an appropriate charge amount, and image fogging and toner scattering can be further suppressed. Even if the volume average particle diameter of the toner is as small as, for example, about 6 to 9 μm, the toner can be provided with an appropriate charge amount, so that the size of the toner particles can be reduced without causing image fogging or toner scattering, and high definition and high quality images can be formed.

According to the invention, it is preferable that the concentration of a colorant in the toner is 10% by weight or more and 15% by weight or less. Herein, the concentration of a colorant in the toner refers to the concentration of a colorant in the particles (hereinafter, referred to as "toner particles") produced from a mixture containing at least a binder resin and the colorant in the production process of the toner, which will be described later, and does not refer to, when the toner is constituted by the toner particles and an external agent such as a plasticizer that is externally added to the toner particles, the concentration of the colorant in a composition containing the toner particles and the external agent, but the concentration of the colorant in the toner particles. By selecting the concentration of the colorant in the toner in the above-described range, the coloring ability of the toner can be improved so that a two-component developer having a small amount of toner necessary to form images with a certain concentration can be realized. However, for example, when conductive material such as carbon black is used as the colorant and the concentration of the colorant in the toner is 10% by weight or more as described above, the electrical resistance of the toner may be too low. On the other hand, in the two-component developer of the invention, the dielectric loss (tan δ) of the toner is selected from the specific range as above, which can prevent the electrical resistance of the toner from being too low. Therefore, the coloring ability of the toner can be improved without causing image fogging and toner scattering due to insufficiency of the charge amount of the toner.

According to the invention, it is preferable that the concentration of the toner in the two-component developer of the invention in the state at the time of production is 3.5% by weight or more and 8.0% by weight or less. The concentration of the toner in the two-component developer that is defined herein refers to a value in the state at the time of production, that is, in the unused state, and does not refer to a value in the state when being supported by a developer holding member. By selecting the concentration of the toner in the above-described range, a reduction in the image density due to insufficiency of the absolute amount of the toner can be prevented, so that images having sufficient image density can be realized. Furthermore, the agitating ability is improved and the toner and the carrier are sufficiently agitated and subjected to frictional electrification. Thus, image fogging and toner scattering due to insufficiency of the charge amount of the toner can be prevented more reliably.

According to the invention, a two-component developing apparatus includes developer supplying means including a developer holding member, and control means, and the two-component developer of the invention is supported by the developer holding member and is conveyed to the position in which the latent image formed on the latent image bearing member is to be developed (hereinafter, referred to as "development position"). At this time, the control means controls the operation of the developer supplying means such that the moving direction of the developer holding member at the development position is opposite (this direction is referred to as "counter direction") to the moving direction of the latent image bearing member at the development position. With this, the two-component developer of the invention is supplied to a latent image formed on the latent image bearing member by the developer holding member that moves in the opposite direction to the latent image bearing member, and the latent image formed on the latent image bearing member is developed by the two-component developer of the invention. In the two-component developing apparatus in which the developer holding member moves in the counter direction with respect to the latent image bearing member, a mechanical load applied to the two-component developer is large at the opposing portion of the developer holding member and the latent image bearing member, so that the coating layer of the carrier contained in the two-component developer is detached, and the hot offset phenomenon may occur in the fixing apparatus of the image forming apparatus. However, in the two-component developing apparatus of the invention, the carrier contained in the two-component developer of the invention used as a two-component developer has excellent adhesiveness between the carrier core material and the coating layer, and the coating layer is hardly detached, and even if the coating layer is detached and mixed with the toner, the acrylic resin contained in the coating layer functions as a parting agent, and therefore, in the two-component developing apparatus, the hot offset phenomenon hardly occurs at the time of fixing. Therefore, by using the two-component developing apparatus of the invention as an image forming apparatus, a reduction in the hot offset occurrence temperature due to detachment of the coating layer of the carrier can be prevented, so that the temperature at which the toner is heated by the fixing member during fixing can be set to a temperature at which the toner can be fixed on a recording material at a sufficient strength, and thus mages having excellent fixing strength can be realized.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1A:
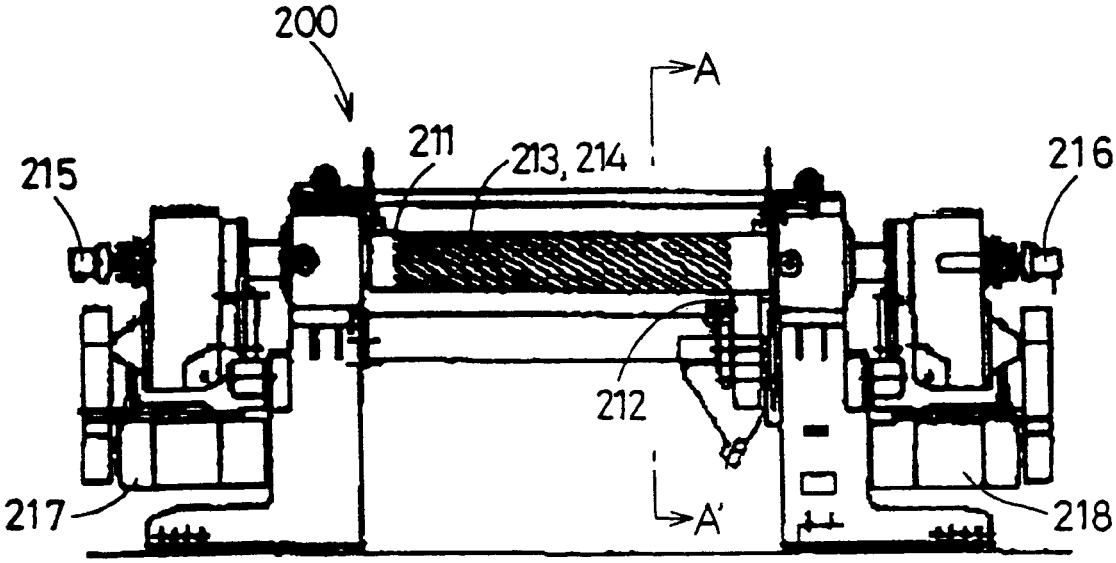
FIG. 1A and FIG. 1B are views schematically showing the structure of a continuous two-roll type kneader.

Now referring to the drawings, preferred embodiments of the invention are described below. The two-component developer of the invention comprises a toner containing a binder resin and a colorant, and a carrier including a carrier core material and a coating layer with which the carrier core material is coated.

[Toner]

The toner contained in the two-component developer of the invention has a dielectric loss (tan δ) of $4.0\times10^{-3}$ or more and $15.0\times10^{-3}$ or less, preferably, $4.5\times10^{-3}$ or more and $14.5\times10^{-3}$ or less. The toner is designed such that the dielectric loss (tan δ) of the toner is in the range from $4.0\times10^{-3}$ to $15.0\times10^{-3}$, so that a toner that can be provided with sufficient charge amount by frictional electrification with a specific carrier, as described below, that is contained in the two-component developer of the invention is achieved. Thus, the charge amount of the toner can be appropriate, so that image density insufficiency, fogging of images and toner scattering can be prevented.

When the dielectric loss (tan δ) of the toner is less than $4.0\times10^{-3}$, even if a specific carrier as described later is combined therewith, the charge amount of the toner becomes excessive, so that when developing latent images with the two-component developer of the invention, the amount of the toner attached to a surface of a latent image bearing member is reduced and the image density of the formed images is lowered. When the dielectric loss (tan δ) of the toner exceeds $15.0\times10^{-3}$, even if a specific carrier as described later is combined therewith, the charge amount of the toner is reduced, so that fogging occurs in the formed images. Furthermore, scattering of the toner occurs, so that scattered toner is attached to the inside of the image forming apparatus and the surface of the latent image bearing member, and attached to the front surface and the back surface of the recording material and thus fogging may increase. Therefore, the dielectric loss (tan δ) of the toner is set to $4.0\times10^{-3}$ or more and $15.0\times10^{-3}$ or less.

The dielectric loss (tan δ) of the toner changes with the type of each component such as the binder resin and the colorant and the content thereof. Furthermore, even if the toner is produced with the same materials, the dispersing state of each component is varied, depending on the production conditions such as the kneading condition and the cooling condition in the kneading process, and the dielectric loss (tan δ) is varied. Therefore, the dielectric loss (tan δ) of the toner can be adjusted in the range stipulated by the invention by selecting, as appropriate, the type of each component such as the binder resin and the colorant and the content thereof and the kneading condition and the cooling condition or other conditions in the kneading process.

The dielectric loss (tan δ) of the toner can be obtained, using the bridge method in the following manner. The bridge method is a basic method for measuring the dielectric constant of a substance. In the bridge method, the dielectric constant of a dielectric is obtained by comparing the electrostatic capacitance Cx when the dielectric is filled between the electrodes of a plate capacitor with the electrostatic capacitance Co when the dielectric is not filled between electrodes of a plate capacitor. In this case, the dielectric constant ∈' is given by ∈'=Cx/Co.

Based on this relationship, the dielectric loss tan δ of the dielectric interposed between the electrodes of a plate capacitor can be obtained by equation (1) below:

$$\tan\delta=1/(\omega Cx\cdot\Delta R) \quad (1)$$

where ω=2πf; f is a measurement frequency; ΔR=R'−Ro; Ro is a conductance when the dielectric is not filled between the electrodes of a plate capacitor; and R' is a conductance when the dielectric is filled between the electrodes of a plate capacitor.

The electrostatic capacitance Co when the dielectric is not filled between the electrodes of a plate capacitor is substantially equal to the electrostatic capacitance when a vacuum is attained between the electrodes of a plate capacitor, and can be obtained by equation (2) below:

$$Co=A/(11.3\times Tx) \quad (2)$$

where A is the effective electrode area of the plate capacitor, and Tx is the thickness of the dielectric layer interposed between the electrodes of the plate capacitor.

In the invention, the dielectric loss of the toner is obtained, using a dielectric loss measuring apparatus (product name: TR-10C manufactured by Ando Electric Co., Ltd). As an oscillator, WBG-9 (product name, manufactured byAndo Electric Co., Ltd.) is used. As a detector of equilibrium point, BDA-9 (product name, manufactured by Ando Electric Co., Ltd.) is used. As a constant temperature bath, TO-19 (product name, manufactured by Ando Electric Co., Ltd.) is used. As electrodes for solid, SE-70 (product name, manufactured by Ando Electric Co., Ltd.) is used. The effective electrode area A of the electrodes for solid is about 2.83 (i.e., 0.952π) $cm^2$.

Then, 1 g of the toner is molded into a tablet with a tablet molding machine, and this tablet is used as a sample for measurement. Using this sample for measurement, the conductance and the electrostatic capacitance (capacitance) are measured in the following manner. First, as a null balance operation, the conductance is set to a predetermined value. The conductance at this time is taken as Ro. Then, the produced sample for measurement is placed in the center of the electrodes for solid and sandwiched by guard electrodes from the above, the frequency of the oscillator is set to 1 kHz, and a voltage of 10V is applied between the electrodes. The conductance and the electrostatic capacitance are measured 15 minutes after the voltage began to be applied between the electrodes. The value of the conductance as measured at this time is taken as R', and the value of the electrostatic capacitance is taken as Cx. After the end of the measurement, the thickness of the sample for measurement is measured at one point in the center and four points at the peripheral portion, and the average is obtained and taken as Tx.

The dielectric loss (tan δ) of the toner is obtained by equation (3) below:

$$\tan\delta=Gx/\omega Cx \quad (3)$$

where ω=2πf; f is a measurement frequency; Gx is a conductance and is obtained by the following equation.

$$Gx=\text{RATIO value}\times(R'-Ro)$$

The RATIO value refers to a constant that is determined for each measurement frequency at the time of measurement. Herein, the measurement frequency f is 1 kHz, and the corresponding RATIO value is $1\times10^{-9}$.

The dielectric constant ∈' of the toner is obtained by the following equation.

$$\in'=Cx/Co=11.3\cdot Tx\cdot Cx/A$$

The resistance R of the toner is obtained by the following equation.

$$R=10A/(Gx\cdot Tx)$$

The toner may contain various additives such as a charge control agent, a parting agent, and a plasticizer, in addition to a binder resin and a colorant.

(Binder Resin)

As the binder resin, binder resins that are commonly used for toner can be used. For example, styrene based resins such as polyester resin and polystyrene, acrylic resins such as acrylic resin, methacrylic resin, polystyrene-acrylic ester copolymer, thermoplastic resin such as vinyl chloride resin, phenol resin, epoxy resin, polyester polyol resin, polyurethane resin, and polyvinyl butyral resin.

Among these, polyester resins are preferably used. As the polyester resin, known polyester resin is used, and among these, polyester resin obtained by subjecting polyol and polybasic acid to condensation polymerization is preferable. The polyester resin may have a crosslinking structure in which at least one of polyol and polybasic acid is polymerized using tri-(or more)valent polyfunctional component so as to be crosslinked. Herein, the polyol refers to compounds having at least two hydroxyl groups and includes alcohols having alcoholic hydroxyl groups and phenols having phenolic hydroxyl groups. The polybasic acid refers to compounds having at least two carboxyl groups and derivatives thereof.

As the polyol used to synthesize the polyester resin, known polyol can be used, and among polyols, examples of bivalent alcohols, that is, diols include ethylene glycol, diethylene glycol, triethylene glycol, 1,2-propylene glycol, 1,3-propylene glycol, dipropyleneglycol, trimethyleneglycol, 1,4-butanediol, 1,4-butenediol, neopentyl glycol, 1,5-pentanediol, 1,6-hexanediol, 1,7-heptanediol, 1,8-octanediol, 1,9-nonanediol, and 1,10-decanediol.

Among the polyols, examples of bivalent phenols include bisphenol A alkylene oxide adducts such as 2,2-bis(4-hydoxyphenyl) propane (trivial name: bisphenol A), hydrogenated bisphenol A, and polyoxyethylene bisphenol A, and hydroquinone.

Examples of the tri- (or more)valent polyols that is the tri-(or more)valent polyfunctional component involved in the crosslinking of the polyester resin include alcohols such as glycerol, 1,2,4-butanetriol, 1,2,5-pentanetriol, 2-methylpropanetriol, 2-methyl-1,2,4-butanetriol, trimethylolethane, trimethylolpropane, pentaerythritol, dipentaerythritol, tripentaerythritol, 1,2,3,6-hexanetetraol, sorbitol, 1,4-sorbitanand sucrose, and phenols such as 1,2,4-benzenetriol.

As the polybasic acid used to synthesize the polyester resin, known polybasic acids can be used. Among polybasic acids, examples of dibasic acids include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, 1,5-naphthalenedicarboxylic acid, 2,6-naphthalene dicarboxylic acid, and anhydrides of these acids and esters of these acids with or lower alcohols (e.g., lower alcohols having 1 to 4 carbon atoms such as methanol, ethanol, propanol, and butanol).

Examples of the tri- (or more) valent polybasic acid that is the tri- (or more)valent polyfunctional component involved in the crosslinking of the polyester resin include 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,5-hexatricarboxylic acid, and anhydrides of these acids and esters of these acids with or lower alcohols (e.g., lower alcohols having 1 to 4 carbon atoms such as methanol, ethanol, propanol, and butanol).

(Colorant)

As the colorant, dyes and pigments commonly used as a colorant of toner can be used. Examples thereof include nigrosine dyes, carmine dyes, various basic dyes, acidic dyes, oil dyes, anthraquinone dyes, benzidine based yellow organic pigments, quinantrin based organic pigments, rhodamine based organic pigments, phthalocyanine based organic pigments, zinc oxide, titanium oxide, and carbon blacks such as furnace black, acetylene black, and thermal black. Among these, carbon blacks are preferable. Furthermore, among carbon blacks, carbon blacks having a primary particle diameter of 15 to 30 nm that has excellent dispersibility in a binder resin are preferable, and acidic carbon blacks (pH 7 or less) that do not damage the characteristics of other components contained in the toner during production of the toner are preferable. The two-component developer of the invention can be used for development of monochrome images and color images by selecting the colors of colorants contained in the toner as appropriate. One type of these colorants can be used alone or a combination of two or more can be used.

The amount of the colorant used is preferably 3 parts by weight or more and 20 parts by weight or less with respect to 100 parts by weight of the binder resin.

In view of the coloring ability of the toner, it is preferable that the concentration of the colorant in the toner is 10% by weight or more and 15% by weight or less. Although no particular problems is caused even if the concentration of the colorant is less than 10% by weight, in order to reduce the amount of toner necessary to form images having a certain image density, the concentration of the colorant is preferably 10% by weight or more. For example, when forming images with an amount of the toner attached to the recording material being set to 0.60 mg/cm$^2$, when the concentration of the colorant is less than 10% by weight, sufficient image density may not be obtained. When the concentration of the colorant is more than 15% by weight, the dispersibility of the colorant into the binder resin is reduced, and dispersion of other components such as charging control agent is prevented, so that the uniformity of the toner is reduced and the dielectric loss (tan δ) of the toner may exceed $15.0\times10^{-3}$, which is the upper limit in the preferable range.

(Charge Control Agent)

As the charge control agent, materials that are commonly used as a charge control agent of toner can be used, and examples thereof include nigrosine dyes, metal azo compounds, metal salts of salicylic acid, and quarternary ammonium salts. One type of these charge control agents can be used alone or a combination of two or more can be used. The amount of the charge control agent to be used is not limited to a particular value, and can be selected as appropriate from a wide range, depending on the type and content of the binder resin, the type and content of the colorant or other various conditions. However, it is preferable that the amount is 0.5 parts by weight or more and 3.0 parts by weight or less with respect to 100 parts by weight of the binder resin.

(Parting Agent)

As the parting agent, materials that are commonly used as a parting agent of toner can be used, and among these, oil based waxes such as paraffin wax and microcrystalline wax, synthetic waxes such as polyethylene wax, Fischer-Tropsch wax and amide wax, animal or plant based waxes such as carnauba wax, candelilla wax, and rice wax are preferable.

The parting agent is dispersed in the toner and bleeds onto the surface of the toner during heating of the toner by the fixing member to allow the toner to exhibit the parting property, and thus serves as an offset preventing agent for preventing the hot offset phenomenon. The offset preventing effect of the parting agent is affected significantly by the melting point of the parting agent and the dispersion state of the parting agent in the toner. Therefore, it is preferable that the melting point of the parting agent is 60° C. or more and 100° C. or less. Herein, the melting point of the parting agent is an endothermic peak temperature corresponding to the melting in the DSC curve in the differential scanning calorimetry (abbreviated as "DSC"). When the melting point of the parting agent is less than 60° C., the kneaded material may be melted and attached to a collision plate in a grinding process in the production of the toner by a kneading and grinding method, which will be described later, so that it may be difficult to produce the toner. When the melting point of the parting agent is more than 100° C., the parting agent cannot bleed sufficiently during fixing, so that the toner may wind around the fixing member.

The acid value of the parting agent is preferably 1.0 mgKOH/g or more and 10.0 mgKOH/g or less, more preferably 1.0 mgKOH/g or more and 4.0 mgKOH/g or less. When the acid value of the parting agent exceeds 10.0 mgKOH/g, the affinity of the parting agent with the binder resin, in particular, polyester resin increases, which makes it difficult for the parting agent to bleed onto the surface of the toner during fixing, so that the hot offset phenomenon may not significantly be prevented.

The amount of the parting agent to be used is not limited to a particular value, and can be selected as appropriate from a wide range, depending on the type and content of the binder resin, the type and content of the colorant or other various conditions. However, it is preferable that the amount is 0.5 parts by weight or more and 5.0 parts by weight or less, more preferably, 1.5 parts by weight or more and 3.5 parts by weight or less, with respect to 100 parts by weight of the binder resin. When the amount of the parting agent used is less than 0.5 parts by weight with respect to 100 parts by weight of the binder resin, the hot offset phenomenon-preventing effect of the parting agent is not sufficiently exhibited, and the hot offset phenomenon may occur. When the amount of the parting agent used is more than 5.0 parts by weight with respect to 100 parts by weight of the binder resin, a phenomenon called filming in which toner is melted and attached in a form of a coating film onto the surface of the latent image bearing member or a developer holding member may occur.

(Plasticizer)

A plasticizer is added for the purpose of improving fluidity of the toner. The plasticizer is preferably added externally to toner particles after formation of toner particles. In the invention, additives that are added externally to toner particles after formation of toner particles are referred to as "external agents". The external agents such as plasticizers may be attached to the surface of the toner particles or a part thereof may be embedded into the toner particles. As the plasticizer, known materials can be used, and for example, colloidal silica, alumina powder, titanium oxide powder, calcium carbonate power can be used. One type of these plasticizers can be used alone or a combination of two or more can be used. The amount of the plasticizer to be used is not limited to a particular value, and can be selected as appropriate from a wide range, depending on the type and content of the binder resin, the type and content of the colorant or other various conditions. However, it is preferable that the amount is 0.1 parts by weight or more and 3.0 parts by weight or less with respect to 100 parts by weight of the toner particles.

The toner contained in the two-component developer of the invention can be produced according to a known method such as kneading and grinding, suspension, emulsion aggregation, and submerged drying. For example, when a method of kneading and grinding is used, toner particles can be formed in the following manner. First, the binder resin and the colorant, and various additives such as charge control agents as described above, if necessary, are mixed with a dry mixer such as HENSCHEL MIXER, and the obtained raw material mixture is melted and kneaded with a kneader such as extruding kneader (extruder). The obtained kneaded product is cooled and the solid product is ground in a grinder such as a jet mill and a speed mill so as to be formed into toner particles.

The thus formed toner particles or toner particles formed by techniques of suspension, emulsion aggregation, submerged drying or the like are classified with a pneumatic classifier, if necessary, to adjust the particle diameter. In the case where the plasticizer is not to be added externally to the toner particles, a toner used for the two-component developer of the invention can be obtained. In the case where the plasticizer is to be added externally to the toner particles, the toner particles and the plasticizer are mixed with a powder mixer such as a HENSCHEL MIXER, a surface reforming apparatus such as a hybridizer or the like after the particle diameter of the toner particles is adjusted as necessary, and thus a toner used for the two-component developer of the invention can be obtained.

When the concentration of the colorant in the toner is at least 10% by weight as described above, it is preferable to use a masterbatch method for production of the toner particles in order to disperse the colorant and other additives uniformly in the binder resin, and to produce toner efficiently without impairing the characteristics of the binder resin.

According to the masterbatch method, the binder resin in an amount of less than a predetermined amount and the colorant in an amount of a predetermined amount are mixed with a mixer in the same manner as described above, and the obtained raw material mixture is heated and kneaded, for example, with a continuous two-roll type kneader, which will be described later, while applying a shearing force. The obtained kneaded product is cooled and solidified, and further roughly ground so that a kneaded and roughly-ground product can be obtained. The remaining binder resin and other additives are mixed with this kneaded and roughly-ground product, and diluted, melted and kneaded with a kneader such as an extruding kneader (extruder). Then, the obtained kneaded product is cooled and solidified in the same manner as above and ground, and the particle diameter is adjusted, if necessary, and thus a toner can be obtained. The binder resin that is kneaded with the colorant in advance may be the same or different type from the one that is mixed with the kneaded and roughly-ground product after kneading.

Figure 1B:
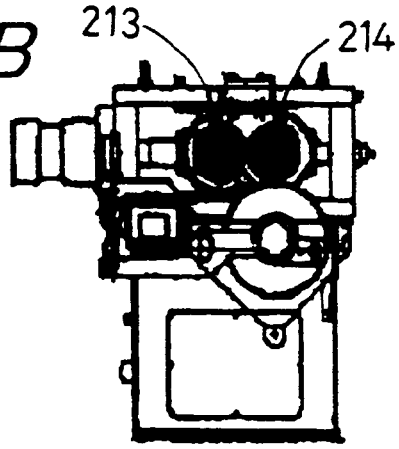

FIG. 1A is a side view schematically showing the structure of a continuous two-roll type kneader 200 that is preferably used in the masterbatch method. FIG. 1B is a cross-sectional view taken along a cross-section line A-A' of the continuous two-roller type kneader 200 shown in FIG. 1A.

The continuous two-roller type kneader 200 includes a raw material-supplying portion 211, a kneaded product-discharging portion 212, a first kneading roll 213, a second kneading roll 214, heating and cooling medium-supplying and discharging portions 215 and 216, and roll-driving motors 217 and 218.

The raw material mixture containing the binder resin and the colorant is supplied to the raw material-supplying portion 211. The first kneading roll 213 and the second kneading roll 214 are provided rotatably about the axis by the roll driving motors 217 and 218, respectively. Inside the first kneading roll 213 and the second kneading roll 214, pipes (not shown) through which a heating medium or a cooling medium passes are provided. The surface temperature of the first kneading roll 213 and the second kneading roll 214 and thus the kneading temperature of the raw material kneaded product can be adjusted by adjusting the temperature of the heating medium or the cooling medium. The heating medium and the cooling medium are supplied from the heating and cooling medium supply and discharging portions 215 and 216 to the first kneading roll 213 and the second kneading roll 214 and are circulated therein, and then discharged. The kneaded product discharging portion 212 discharges the kneaded product to the outside of the continuous two-roller type kneader 200.

According to the continuous two-roller type kneader 200, the raw material mixture is supplied between the first kneading roll 213 and the second kneading roll 214 from the raw material-supplying portion 211, and heated there by the surface temperature of the first kneading roll 213 and the second kneading roll 214 and also applied continuously with a shearing force by the rotations of these rolls, and kneaded while moving gradually in the direction of the kneaded product discharging portion 212. The thus obtained kneaded product is discharged from the kneaded product discharging portion 212 to the outside of the continuous two-roller type kneader 200.

The dielectric loss (tan δ) of the toner can be adjusted by the dispersibility of each component such as the colorant in the toner as described above, and for example, when the toner is produced by kneading and grinding, the dielectric loss (tan δ) of the toner can be adjusted by selecting the melting kneading condition as appropriate. For example, when the raw material mixture or the kneaded and roughly-ground product is to be melted and kneaded by using an extruding kneader (extruder), a toner whose dielectric loss (tan δ) is in the preferable range can be produced by setting the cylinder temperature to 80 to 160° C., preferably 100 to 140° C., setting the barrel rotation speed to 100 to 500 rotations per minute (100 to 500 rpm), preferably 200 to 400 rotations per minute (200 to 400 rpm), and setting the raw material (mixture) supply speed to 5 to 25 kg/hour, preferably 10 to 20 kg/hour.

[Carrier]

The carrier contained in the two-component developer of the invention includes a carrier core material having magnetism and a coating layer with which the carrier core material is coated.

(Carrier Core Material)

As the carrier core material, magnetic particles that are commonly used as a carrier core material of a carrier of a two-component developer can be used, and among these, ferrite particles can be preferably used. The ferrite particles have a small change in the electrical resistance over time, and the electrical resistance is hardly changed even if the ambient condition such as temperature and humidity is changed. Therefore, a change in the charging characteristics of the carrier over time and a change due to variations in the ambient conditions can be suppressed by using the ferrite particles as the carrier core material. Therefore, under various ambient conditions, the charge amount of the toner can be kept constant over a long period of time, and high quality images can be formed. Furthermore, the head of a magnetic blush formed by the ferrite particles is soft and therefore applies only a small mechanical load to the latent image bearing member, so that degradation of image quality due to rubbing on the surface of the latent image bearing member can be prevented.

Examples of the ferrite particles include zinc ferrite, nickel ferrite, copper ferrite, nickel-zinc ferrite, manganese-magnesium ferrite, copper-magnesium ferrite, manganese-zinc ferrite, and manganese-copper-zinc ferrite. These ferrite particles can be obtained by mixing raw materials, calcining and grinding the mixture, and then firing the same, and the surface shape of the particles can be changed by changing the firing temperature. One type of these magnetic particles serving as the carrier core material can be used alone or a combination of two or more can be used.

(Coating Layer)

The coating layer with which the carrier core material is coated can be formed of a resin. As the resin, acrylic resin and other resins such as silicone resin, fluorocarbon resin and alkyd resin can be used. In the invention, the content of the acrylic resin contained in the coating layer of the carrier is 5% by weight or more and 50% by weight or less based on the total amount of the coating layer.

The acrylic resin has better adhesiveness to the carrier core material than other resins such as silicone resin that is used therewith. Therefore, when the content of the acrylic resin in the coating layer is 5% by weight or more based on the total amount of the coating layer, a carrier having excellent adhesiveness between the carrier core material and the coating layer can be realized, and detachment of the coating layer from the carrier core material during agitation can be suppressed. Furthermore, the acrylic resin contained in the coating layer has a lower softening point than the melting point of silicone resin, fluorocarbon resin or the like, so that the acrylic resin is melted immediately at a heating temperature of the toner by the fixing member during fixing, for example, at a temperature of about 170 to 220° C., and can serve as a parting agent. Therefore, even if the coating layer is detached from the carrier core material and mixed with the toner, the hot offset phenomenon hardly occurs. Therefore, even if a high melting point resin such as silicone resin and fluorocarbon resin is used together with the acrylic resin as the resin constituting the coating layer, the hot offset occurrence temperature is not lowered. That is to say, in the two-component developer of the invention, a reduction in the hot offset occurrence temperature due to detachment of the coating layer of the carrier can be prevented.

Furthermore, when only a resin having excellent insulating properties such as silicone resin (hereinafter, referred to as "high insulating resin") is used as the resin constituting the coating layer, the electrical resistance of the carrier becomes too high, so that even if this carrier is combined with the toner as described above, the toner cannot be provided with preferable charge amount, and therefore the charge amount of the toner may be excessive. Moreover, the edge effect and a phenomenon in which charges are accumulated in the carrier occur, so that image quality may be degraded. In the invention, the content of the acrylic resin in the coating layer is 5% by weight or more and 50% by weight or less based on the total amount of the coating layer, so that even if the high insulating resin such as silicone resin is used with the acrylic resin, the electrical resistance of the carrier is preferable to the toner. Therefore, since the charge amount of the toner can be preferable, degradation of image quality due to carrier lifting, the edge effect and the phenomenon of charge accumulation in the carrier, image density insufficiency due to excessive charge amount of the toner, image fogging and toner scattering due to insufficient charge amount of the toner can be suppressed.

On the other hand, when the content of the acrylic resin in the coating layer of the carrier is less than 5% by weight, the adhesiveness between the coating layer and the carrier core material becomes insufficient, and the amount of detachment of the coating layer increases. Furthermore, since the amount of acrylic resin present in the detached coating layer is reduced, the parting effect by the acrylic resin cannot sufficiently be exhibited. Therefore, reduction in the hot offset occurrence temperature due to detachment of the coating layer cannot be suppressed. Furthermore, when a resin having excellent insulating properties (high insulating resin) such as silicone resin is used together with the acrylic resin as the resin constituting the coating layer, the ratio of the high insulating resin in the coating layer becomes relatively high, so that the high insulation of the high insulating resin increases the electrical resistance of the carrier to too high, and therefore the edge effect and the phenomenon of charge accumulation, which degrades the image quality.

On the other hand, when the content of the acrylic resin in the coating layer of the carrier is more than 50% by weight, when a high insulating resin such as silicone resin is used together with the acrylic resin as the resin constituting the coating layer, the ratio of the high insulating resin in the coating layer becomes relatively low, so that the electrical resistance of the carrier becomes too low, and therefore, even if the dielectric loss (tan δ) of the toner is selected from the above range, a sufficient charge amount cannot be provided to the toner, and the charge amount of the toner is reduced. Therefore, fogging and toner scattering occurs.

Therefore, the content of the acrylic resin in the coating layer of the carrier is 5% by weight or more and 50% by weight or less.

Examples of the acrylic resin include those obtained by homopolymerizing or copolymerizing acrylic monomers.

As the acrylic monomers used for synthesis of acrylic resins, known acrylic monomers can be used, and examples thereof include acrylic acid, acrylic esters such as alkyl (preferably alkyl having 1 to 18 carbon atoms) esters of acrylic acid such as methyl acrylate, ethyl acrylate, isopropyl acrylate, n-butyl acrylate, t-butyl acrylate, isobutyl acrylate, n-octyl acrylate, 2-ethylhexylacrylate, n-octadecylacrylate (stearyl acrylate) and n-dodecyl acrylate (lauryl acrylate), and aryl esters of acrylic acid such as phenyl acrylate, acrylic ester derivatives such as dimethyl aminoethyl acrylate and diethyl aminoethyl acrylate, methacrylic esters such as alkyl (preferably alkyl having 1 to 18 carbon atoms) esters of methacrylic acid such as methyl methacrylate, ethyl methacrylate, n-butyl methacrylate, isopropyl methacrylate, t-butyl methacrylate, n-octyl methacrylate, 2-ethylhexyl methacrylate, n-octadecylmethacrylate (stearylmethacrylate) and n-dodecyl methacrylate (lauryl methacrylate), and aryl esters of methacrylic acid such as phenyl methacrylate, and methacrylic ester derivatives such as diethyl aminoethyl methacrylate and dimethyl aminoethyl methacrylate. Furthermore, alicyclic acrylic monomers such as alicyclic alkyl esters of acrylic acid such as cyclohexyl acrylate, and alicyclic alkyl ester derivatives of methacrylic acid such as cyclohexyl methacrylate and cyclopentyl methacrylate also can be used. One type of these acrylic monomers can be alone or a combination of two or more can be used.

Among the acrylic resins, copolymers of alicyclic acrylic monomer and at least one type of acrylic monomer selected from the group consisting of acrylic acids, acrylic esters and derivative thereof, and methacrylic acids, methacrylic esters and derivative thereof are preferable. In this case, there is no limitation regarding the ratio of the alicyclic acrylic monomer and the other acrylic monomer(s), but it is preferable the alicyclic acrylic monomer accounts for 40% by weight or more and 80% by weight or less based on the total amount of the acrylic monomers.

The acrylic resin may be obtained by copolymerizing the acrylic monomer with other ethylene unsaturated monomer. As the ethylene unsaturated monomer that can be copolymerized with the acrylic monomer, known monomers can used, and examples thereof include vinyl aromatic monomers such as styrene, divinyl benzene, vinyl toluene, α-methyl styrene, p-ethyl styrene, α-chlorostyrene, o-chlorostyrene, m-chlorostyrene and p-chlorostyrene, vinyl ester monomers such as vinyl acetate and vinyl propionate, vinyl ether monomers such as vinyl-n-butyl ether, vinyl phenyl ether and vinyl cyclohexane ether, diolefin monomers such as butadiene, isoprene and chloroprene, and monoolefin monomers such as ethylene, propylene, isobutylene, 1-butene, 1-pentene and 4-methyl-1-pentene. One type of these ethylene unsaturated monomers can be used alone or a combination of two or more can be used. When the acrylic resin is a copolymer of the acrylic monomer with (an)other ethylene unsaturated monomer(s), it is preferable that in the acrylic resin, the acrylic monomer accounts for 50% by weight or more based on the total amount of the monomers.

It is preferable to use both the acrylic resin and the silicone resin as the resin constituting the coating layer. The silicone resin has excellent parting property, so that when the silicone resin is used together with the acrylic resin as the resin constituting the coating layer, the toner is prevented from being melted and attached onto the carrier surface while the developer is agitated. Therefore, the charging characteristics of the carrier are prevented from changing over repeated use, so that the charge amount of the toner can be kept constant over a long period and uniform images can be provided.

As the silicone resin, those that are commonly used in this field can be used, and examples thereof include silicone varnish (TSR115, TSR114, TSR102, TSR103, YR3061, TSR110, TSR116, TSR117, TSR108, TSR109, TSR180, TSR181, TSR187, TSR144, and TSR165 (all are product names) manufactured by TOSHIBA CORPORATION, KR271, KR272, KR275, KR280, KR282, KR267, KR269, KR211, KR212 (all are product names) manufactured by Shin-Etsu Silicones Co., Ltd. etc.), alkyd-modified silicone varnish (TSR184 and TSR185 (all are product names) manufactured by TOSHIBA CORPORATION, etc.), epoxy-modified silicone varnish (TSR194 and YS54 (all are product names) manufactured by TOSHIBA CORPORATION, etc.), polyester-modified silicone varnish (TSR187 (product name) manufactured by TOSHIBA CORPORATION, etc.), acrylic-modified silicone varnish (TSR170 and TSR171 (all are product names) manufactured by TOSHIBA CORPORATION, etc.), urethane-modified silicone varnish (TSR175 (product name) manufactured by TOSI-IBA CORPORATION, etc.), and reactive silicone varnish (KA1008, KBE1003, KBC1003, KBM303, KBM403, KBM503, KBM602 and KBM603 (all are product names) manufactured by Shin-Etsu Silicones Co., Ltd. etc.).

It is preferable to add conductive particles to the coating layer in order to control the electrical resistance of the carrier. By dispersing conductive particles in the coating layer, the conductive particles serve as a resistance control agent so that the carrier is provided with appropriate conductivity. Therefore, the carrier functions as a developing electrode, and development is performed in a state in which the developing electrode is very close to the surface of the latent image bearing member such as a photosensitive member on which a latent image to be developed is formed, so that original images can be reproduced faithfully in any portion, even for line portions and large-area solid image portions such as black-solid images. Furthermore, since the phenomenon of charge accumulation in the carrier is further suppressed, the charge amount of the toner is stabilized over a long period, and it becomes easy to control the concentration of the toner in the developer that is supported by the developer holding member, and thus high quality images without non-uniformity in the images can be formed stably over a long period.

As the conductive particles added to the coating layer, for example, conductive metal oxides such as carbon black, graphite, black titanium oxide, zinc oxide, iron oxide, titanium oxide, tin oxide and magnesium oxide, and fine powder of metal salts of inorganic acids such as potassium titanate, calcium titanate and aluminum borate can be used. There is no limitation regarding the particle diameter of the conductive particles, but the particle diameter is preferably 0.01 to 10 μm. There is no limitation regarding the amount of the conductive particles to be added, but the amount is preferably 5 to 20% by weight based on the total amount of the coating layer.

Other additives than the conductive particles may be added to the coating layer. Examples of the additives include non-conductive additives such as silicon oxide, alumina, barium sulfate and calcium carbonate.

The carrier used in the two-component developer of the invention can be produced by coating the magnetic particles serving as the carrier core material with a solution (hereinafter, "coating resin solution") obtained by dissolving and/or dispersing the acrylic resin and other resin such as silicone resin constituting the coating layer, and various additives such as conductive particles, if necessary, in a suitable solvent, and drying and curing the coating film. As the method for coating the carrier core material with the coating resin solution, for example, an immersion method of immersing the carrier core material in the coating resin solution, a spraying method of spraying the coating resin solution to the carrier core material, a fluidized bed method of spraying the coating resin solution to the carrier core material in a state in which the carrier core material is suspended in the air or the like by fluidized air, and a kneader coater method of mixing the carrier core material and the coating resin solution in a kneader coater and removing the solvent or other known methods can be used.

It is preferable that the ratio of the coating layer in the carrier obtained in this manner is 5 parts by weight or more and 20 parts by weight or less with respect to 100 parts by weight of the carrier core material. The electrical resistance of the carrier can be appropriate by selecting the ratio of the coating layer in the carrier in the above range, so that the toner can be provided with an appropriate charge amount, and reduction in the image density due to an excessive charge amount of the toner, image fogging and toner scattering due to an insufficient charge amount of the toner can be prevented reliably. Furthermore, charges generated in the toner by frictional electrification are prevented from being attenuated through the carrier, and the charge amount of the toner can be maintained. Furthermore, it is prevented that the carrier core material is exposed by a mechanical load generated by the collision between carrier particles, collision between the carrier and the toner, collision between the carrier and the container containing the developer at the time of agitating the developer, so that a change in the charging characteristics of the carrier due to an increase of the exposed portion of the carrier can be suppressed, and thus the durability of the two-component developer can be improved. Therefore, a two-component developer with which high quality images having a sufficient image density without image defects due to fogging and toner scattering can be formed stably over a long period can be realized.

When the ratio of the coating layer in the carrier is less than 5 parts by weight with respect to 100 parts by weight of the carrier core material, the exposed portion of the carrier core material becomes large, and toner may not be charged stably. Furthermore, the electrical resistance of the carrier becomes too low, the charges generated in the toner by friction electrification are attenuated through the carrier, and the charge amount of the toner cannot be maintained, and image fogging and toner scattering may occur. The coating layer is detached by a mechanical load generated by the collision between carrier particles, collision between the carrier and the toner, collision between the carrier and the container containing the developer at the time of agitating the developer, and the exposed portion of the carrier core material is increased, so that a change in the charging characteristics of the carrier may be changed, and thus the durability of the two-component developer may not be obtained. When the ratio of the coating layer in the carrier is more than 20 parts by weight with respect to 100 parts by weigh of the carrier core material, the electrical resistance of the carrier becomes too high, and the charge amount of the toner may become excessive, and the amount of the toner attached to the latent image bearing member such as a photoreceptor is reduced, and thus a sufficient image density may not be formed.

Furthermore, the weight average particle diameter of the carrier is preferably 50 μm or more and 100 μm or less, more preferably 60 μm or more and 90 μm or less. By selecting the weight average particle diameter of time carrier in this range, occurrence of the carrier lifting phenomenon can be further suppressed, and occurrence of partial transfer defects in the images can be prevented more reliably. Moreover, the charging ability of the carrier to the toner becomes appropriate and the toner can be provided with an appropriate charge amount, so that image density insufficiency, image fogging and toner scattering can be further suppressed. Therefore, high quality images having a sufficient image density without image defects such as fogging and partial transfer defects can be formed more reliably. Even if the volume average particle diameter of the toner is as small as, for example, about 6 to 9 μm, the toner can be provided with an appropriate charge amount, so that the size of the toner particles can be reduced without causing image fogging or toner scattering, and high definition and high quality images can be formed.

When the weight average particle diameter of the carrier is less than 50 μm, the electrostatic attraction between individual carrier particles and the developer holding member is reduced, so that carrier lifting tends to occur, which may lead to partial transfer defects in the images and reduction in the image density. When the weight average particle diameter of the carrier is more than 100 μm, individual carrier particles become too large, so that individual toner particles cannot be charged stably, which may lead to degradation of the developing property and may not provide desired image density. In particular, when the volume average particle diameter of the toner is as small as, for example, about 6 to 9 μm, the charge amount of the toner becomes too small, and image fogging and toner scattering may occur.

The two-component developer of the invention can be produced by mixing the thus obtained toner and carrier with a mixer such as Nauter mixer.

The concentration of the toner in the thus obtained two-component developer of the invention is preferably 3.5% by weight or more and 8.0% by weight or less, and more preferably 4.0% by weight or more and 7.0% by weight or less in the state at the time of production. By selecting the concentration of the toner in this range, the reduction in the image density due to the insufficient absolute amount of the toner can be prevented, so that images having sufficient image density can be realized. Furthermore, the agitating property can be improved, and the toner and the carrier are agitated sufficiently and subjected to frictional electrification, so that image fogging and toner scattering due to insufficient charge amount of the toner can be prevented more reliably.

When the concentration of the toner in the two-component developer is less than 3.5% by weight, the absolute amount of the toner contained in the developer becomes too small, and the amount of the toner used to develop a latent image becomes insufficient. Therefore, even if the concentration of the colorant in the toner is 10% by weight or more, sufficient image density may not be obtained. When the concentration of the toner in the two-component developer is more than 8.0% by weight, the agitating ability of the developer agitating portion becomes insufficient, and the toner may not be provided with a sufficient charge amount, which may lead to image fogging and toner scattering.

Figure 2:
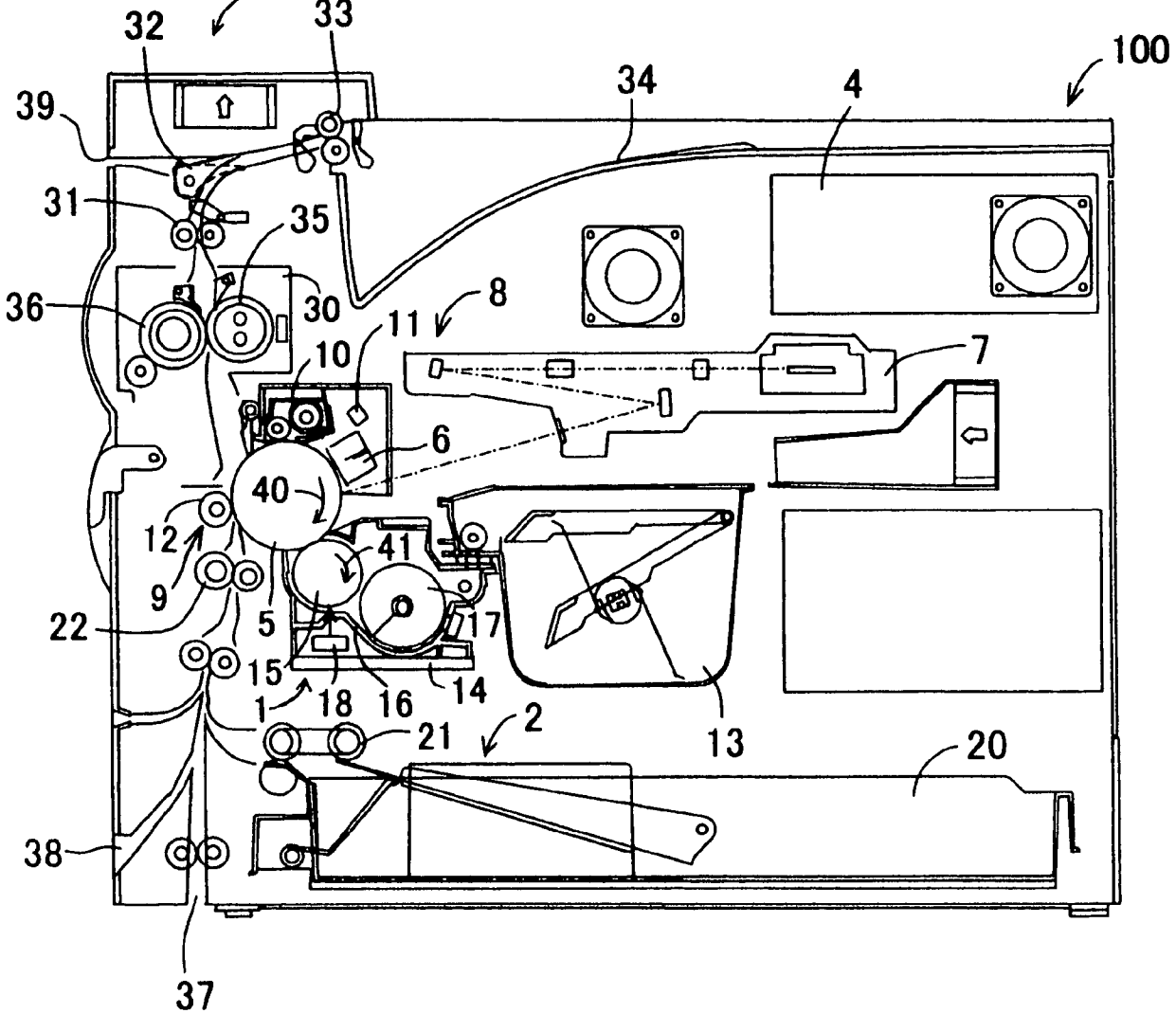
FIG. 2 is a front view of arrangement schematically showing the structure of an image forming apparatus including a two-component developing apparatus according to another embodiment of the invention.

FIG. 2 is a front view of arrangement schematically showing the structure of an image forming apparatus 100 including a two-component developing apparatus 1, which is another embodiment of the invention. The image forming apparatus 100 includes an image forming portion 8 including the two-component developing apparatus 1, a recording material-supplying portion 2, an image fixing portion 3 and a control portion 4.

The image forming portion 8 includes a photoreceptor drum 5, charging means 6 opposed to the circumferential surface of the photoreceptor drum 5, an exposure unit 7, the two-component developing apparatus 1, transfer means 9, a cleaning unit 10 and discharging means 11.

The photoreceptor drum 5 includes a cylindrical or columnar conductive substrate and a photoconductive layer formed on the surface of the conductive substrate. The photoreceptor drum 5 is driven so as to rotate at a predetermined circumferential speed Vp in the direction shown by arrow 40 by driving means (not shown) (hereinafter, this circumferential speed Vp is also referred to as "rotational circumferential speed" of the photoreceptor drum 5).

The charging means 6 is constituted by a contact-type or non-contact type charging apparatus such as a charging roller and a charger, and charges the circumferential surface of the photoreceptor drum 5 to a predetermined polarity and potential.

The exposure unit 7 is constituted by a laser unit such as a semiconductor laser, and irradiates with light the circumferential surface of the photoreceptor drum 5 that is charged by the charging means 6 based on the image information transmitted from the control portion 4, so that an electrostatic latent image is written in the circumferential surface.

The two-component developing apparatus 1, which is another embodiment of the invention, includes developer supply means 14, toner replenishment means 13, control means 18 for controlling the components inside the two-component developing apparatus 1 including the developer supply means 14 and the toner replenishment means 13. The developer supply means 14 includes a developing roller 15, which is a developer holding member provided rotatably so as to be opposed to the photoreceptor drum 5, a developer-containing container 16 for containing the two-component developer of the invention in its internal space while supporting the developing roller 15 and a developer agitator 17 provided inside the developer-containing container 16. The toner replenishment means 13 is provided in communication with the developer-containing container 16, and contains the toner used for the two-component developer of the invention inside. The control means 18 can be realized by a processing circuit such as a microcomputer.

The developing roller 15 has a shape of, for example, cylindrical, ard is provided with magnetic pole members (not shown) around the rotating shaft (not shown) inside and has a plurality of magnetic poles. The developing roller 15 is supported rotatably by the developer-containing container 16 via the rotation shaft, and is driven so as to rotate in the direction shown by the arrow 41 by the driving means such as a motor (not shown).

The developer agitator 17 agitates the two-component developer of the invention contained in the developer-containing container 16 and the toner that is replenished from the toner replenishment means 13 to charge the toner and the carrier with the opposite polarities and conveys the toner and the carrier to the developing roller 15. The developing roller 15 supports the two-component developer of the invention and conveys the developer to a position in which the latent image formed on the photoreceptor drum 5, which is a latent image bearing member, is to be developed (hereinafter, referred to as "development position"), that is, to a portion in which the developing roller 15 and the photoreceptor drum 5 are opposed to each other. The toner replenishment means 13 replenishes the toner to the developer-containing container 16. A voltage is applied to the developing roller 15 by power source means (not shown).

The two-component developing apparatus 1 agitates the two-component developer of the invention by the developer agitator 17 to charge the developer, and supply the developer to the development position with the developer being supported by the developing roller 15. At this time, a voltage is applied to the developing roller 15 by the power source means, so that an electric field is generated between the photoreceptor drum 5 and the developing roller 15, and this electric field allows the toner on the surface of the developing roller 15 to be attached onto the surface of the photoreceptor drum 5. Thus, the latent image formed on the photoreceptor drum 5 is developed, and a toner image is formed on the outer circumferential surface of the photoreceptor drum 5.

In this embodiment, the developer supply means 14 is controlled by the control means 18 so that the moving direction of the developing roller 15 at the development position is opposite (counter direction) to the moving direction of the photoreceptor drum 5 at the development position. That is to say, the developing roller 15 is driven so as to rotate in the same direction as the photoreceptor drum 5, and moves in the opposite direction (counter direction) with respect to the photoreceptor drum 5 at the development position, which is the portion in which the photoreceptor drum 5 and the developing roller 15 are opposed to each other.

Thus, compared with the case in which the photoreceptor drum 5 and the developing roller 15 move in the same direction at the development position, the frequency of the contact of a magnetic brush formed on the surface of the development roller 15 with respect to the photoreceptor drum 5 increases, it is possible to form high quality images with high density and without partial transfer defects. Furthermore, since a shearing force is generated between the magnetic brush on the surface of the developing roller 15 and the photoreceptor drum 5, occurrence of carrier lifting can be prevented.

However, in the two-component developing apparatus in which the developing roller 15 and the photoreceptor drum 5 move in the counter direction, a mechanical load applied to the two-component developer is large at the portion in which the developing roller 15 and the photoreceptor drum 5 are opposed to each other, and therefore the coating layer of the carrier contained in the two-component developer may be detached, and the hot offset phenomenon may be caused in a fixing apparatus 30 as described later.

However, in the two-component developing apparatus 1 of the embodiment, the two-component developer of the invention as described above is used, so that the hot offset phenomenon is hardly caused in a fixing apparatus 30 at the time of fixing. The carrier contained in the two-component developer of the invention has excellent adhesiveness between the carrier core material and the coating layer so that the coating layer is hardly detached, and even if the coating layer of the carrier is detached and mixed with the toner, the acrylic resin contained in the coating layer serves as a parting agent. In other words, in the image forming apparatus 100 using the two-component developing apparatus 1 of the embodiment, a reduction in the hot offset occurrence temperature due to detachment of the coating layer of the carrier can be prevented. Therefore, the heating temperature of the toner by the fixing roller 35 of the fixing apparatus 30, that is, the surface temperature of the fixing roller 35 is set to a temperature at which the toner is fixed to a recording material at a sufficient strength, and images having an excellent fixing strength can be formed.

The two-component developer of the invention can be used not only for the two-component developing apparatus 1 of the invention, but also for a known two-component developing apparatus using a two-component developer.

The transfer means 9 is contact-type transfer means, and includes a transfer roller 12 and voltage-applying means (not shown). The toner image on the circumferential surface of the photoreceptor drum 5 is transferred onto the recording material by applying a voltage from the transfer roller 12 side of the recording material to charge the recording material and further by pressing with the transfer roller 12. The recording material is supplied to the transfer means 9 by the recording material-supplying portion 2 as described later in synchronization with the exposure by the exposure unit 7. It should be noted that the transfer means 9 may be of a contact type using a transfer belt (not shown) instead of the transfer roller 12, and may be non-contact type transfer means.

The cleaning unit 10 includes a cleaning blade made of an elastic material, and removes the toner remaining on the circumferential surface of the photoreceptor drum 5 after the toner image is transferred onto the recording material.

The discharge means 11 includes a discharge lamp and removes the charges on the circumferential surface of the photoreceptor drum 5 after cleaning.

In the image forming portion 8, the circumferential surface of the photoreceptor drum 5 is charged uniformly by the charging means 6, and exposed to light from the exposure unit 7, so that a latent electrostatic image is written. This latent electrostatic image is visualized by the two-component developer supplied from the two-component developing apparatus 1 so that a toner image is formed on the circumferential surface of the photoreceptor drum 5. This toner image is transferred to a recording material by the transfer means 9. After transfer, the photoreceptor drum 5 is subjected to removal of the remaining toner by the cleaning unit 10 and charge removal by the discharging means 11 so as to be cleaned. By repeating this series of operations, a plurality of images are formed.

The recording material-supplying portion 2 includes a recording material-accommodating tray 20, a pick-up roller 21 and a resist roller 22. The recording material-accommodating tray 20 is a tray accommodating recording materials such as regular paper, color copier sheets, and OHP films. The recording material is replenished to the recording material-accommodating tray 20 by drawing the recording material-accommodating tray 20 in the direction to the front side (operation side) of the image forming apparatus 100. The pick-up roller 21 supplies the recording materials in the recording material-accommodating tray 20 one by one separately to the resist roller resist roller 22. The resist roller 22 supplies the recording material successively between the photoreceptor drum 5 and the transfer means 9 in synchronization with exposure of the circumferential surface of the photoreceptor drum 5 to the light from the exposure unit 7 in the image forming portion 8.

With the recording material-supplying portion 2, the recording material accommodated in the recording material-accommodating tray 20 is supplied to the image formatting portion 8 via the pick-up roller 21 and the resist roller 22.

The image fixing portion 3 includes a fixing apparatus 30, a conveying roller 31, a switching gate 32, a reversing roller 33, and a mounting tray 34. The fixing apparatus 30 includes a fixing roller 35 and a pressing roller 36 provided in contact with the fixing roller 35. The fixing roller 35 includes heating means and heated to a predetermined temperature. The fixing apparatus 30 successively receives the recording material on which the toner image is transferred by the transfer means 9 of the image forming portion 8 and lets the recording material pass through a contact portion (nip portion) between the fixing roller 35 and the pressing roller 36 so that the toner image is fixed onto the recording material by heating and pressing by the fixing roller 35 and the pressing roller 36. The recording material is sandwiched between the fixing roller 35 and the pressing roller 36 and conveyed with the rotation of the fixing roller 35 and the pressing roller 36. With the operation of the fixing apparatus 30, an image is formed (recorded) on the recording material. The conveying roller 31 supplies the image-recorded recording material by the fixing apparatus 30 to the switching gate 32. The switching gate 32 switches the supply path of the image-recorded recording material.

When a paper-out tray of the image-recorded recording material is set in the mounting tray 34 provided outside the image forming apparatus 100, the switching gate 32 supplies the image-recorded recording material to the reversing roller 33, and the recording material is let out to the mounting tray 34 via the reversing roller 33. The mounting tray 34 is provided outside the image forming apparatus 100 and lets out the image-recorded recording material from the image forming apparatus 100 and stores the recording materials.

On the other hand, when two-sided image formation or post-process is to be performed, the image-recorded recording material is supplied to the reversing roller 33 by the switching gate 32. The reversing roller 33 does not pass the recording material through, but rotates in the reverse direction after letting out a part of the recording material in the direction of the mounting tray 34 while sandwiching the recording material and supplies the recording material in the reverse direction toward the switching gate 32. In this case, the switching gate 32 is switched from the state shown by a solid line to the state shown by a broken line, so that the image-recorded recording material is supplied to a recording material resupply conveying apparatus (not shown) that is mounted outside the image forming apparatus 100 for two-sided image formation or post-process. When forming a two-sided image, the image-recorded recording material is supplied again to the image forming apparatus 100 via the recording material resupply conveying apparatus. When a post process is performed, the image-recorded recording material is supplied from the recording material resupply conveying apparatus to a post-process apparatus via another switching gate (not shown) and further via a relay conveying apparatus.

With the image fixing portion 3, the recording material on which an image is recorded after a toner image is fixed by the fixing apparatus 30 is conveyed to the reversing roller 33 via the conveying roller 31 and the switching gate 32, and is let out to the mounting tray 34 or conveyed back to the relay conveying apparatus or the recording material resupply conveying apparatus (not shown) via the switching gate 32 again, depending on the settings.

The control 4 is provided in a space above and below the exposure unit 7 inside the image forming apparatus 100, and includes a circuit substrate that controls an image forming process, an interface substrate that receives image data from an external apparatus and a power unit (not shown). The power unit supplies power not only to the circuit substrate and the interface substrate, but also to each apparatus in the image forming portion 8, the recording material-supplying portion 2 and the image fixing portion 3.

Conveying paths 37, 38, and 39 are provided on the lower surface and the side surface of the image forming apparatus 100. The conveying paths 37, 38, and 39 are used to convey the recording material to the inside or the outside of the image forming apparatus 100 when an external apparatus is connected to the image forming apparatus 100. Examples of the external apparatus include, not only the recording material resupply conveying apparatus, the relay conveying apparatus and the post-process apparatus, but also a recording material supply apparatus having a single or a plurality of recording material-accommodating tray so that a large number of recording materials of the same size are accommodated or recording materials of a plurality of sizes are accommodated.

The two-component developing apparatus 1 of the invention is not limited to be used in the image forming apparatus 100, but can be used in known electrophotographic image forming apparatuses employing a two-component developer.

EXAMPLES

Hereinafter, the invention will be more specifically described by way of examples and comparative examples.

The property values in the examples of the invention were measured in the following manner.

[Weight Average Particle Diameter of Carrier]

The weight average particle diameter of the carrier was obtained in the following manner according to Japanese Industrial Standard (JIS) H2601.

Five sieves having a pore diameter of 149 μm, 105 μm, 74 μm, 63 μm, and 44 μm were prepared. These sieves were stacked such that the pore diameters were 149 μm, 105 μm, 74 μm, 63 μm, and 44 μm in this order from the above, and a saucer was provided under each sieve. About 100 g of a sample were weighed down to the digit of 0.1 g, and were placed on the sieve having a pore diameter of 149 μm that was on the top. Then, each sieve was shaken for 15 minutes at 285 horizontal rotations per minute (285 rpm), and 150 vibrating rotations per minute (150 rpm) by a shaker (product name: AS400, manufactured by Retsch Co., Ltd.). After shaking, the sample collected in the saucer provided under each sieve was weighed. The ratio in weight of the sample collected in each saucer with respect to the initially weighed sample was obtained in weight percentage and then the weight average particle diameter was obtained based on this ratio.

[Volume Average Particle Diameter of Toner]

The particle diameter distribution was measured with a measuring apparatus Multisizer II (product name, manufactured by Coulter), and the volume average particle diameter D50 (μm) of the toner was obtained.

[Frictional Electrification Amount of Toner and Toner Concentration]

Figure 3:
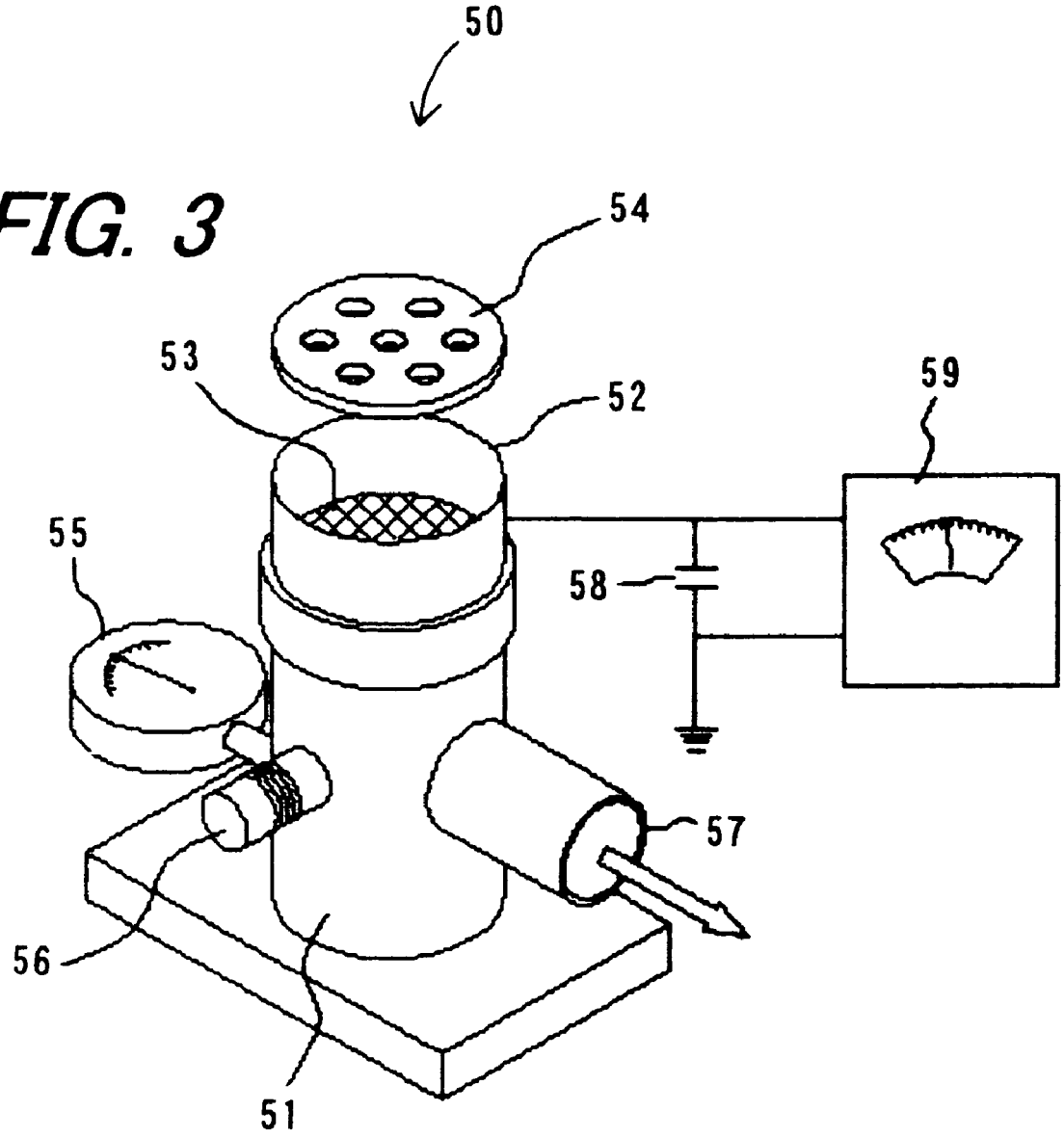
FIG. 3 is a perspective view schematically showing the structure of an apparatus for measuring the frictional electrification amount.

Using a apparatus 50 for measuring the frictional electrification amount shown in FIG. 3, measurement was performed at a temperature of 23° C. and a relative humidity of 60% in the following manner. First, about 0.2 g of the two-component developer collected from the surface of the developing roller was place in a metal measurement container 52 provided with a 500-mesh conductive screen 53 at its bottom, and a metal lid 54 was put thereon. The total weight of the measurement container 52 was weighed, and this value was taken as W1 (g).

Then, an aspirator 51 was used for suction from a suction port 57 so that the pressure indicated by a vacuum meter 55 was reduced to 250 mmHg by adjusting an air volume regulating valve 56. In this state, suction was performed from the suction port 57 for 2 minutes so that the toner was drawn and removed by suction. At this time, the voltage between the electrodes of a capacitor 58 connected to the measurement container 52 was measured with an electrometer 59, and this value was taken as V (V; volt). At least the portion of the aspirator 51 that is in contact with the measurement container 52 is made of an insulator. The total weight of the measurement container 52 after the suction was weighed and this value was taken as W2 (g).

The measurement results were substituted in Equation (4) below, and the frictional electrification amount Q (μC/g) was obtained:

$$Q=(C\times V)/(W1-W2 \quad (4)$$

where C is the capacitance (μF) of the capacitor 58.

Furthermore, the above measurement results were substituted in Equation (5) below, and the toner concentration C (wt %) of the two-component developer was obtained.

$$C=(W1-W2)/W1 \quad (5)$$

[Dielectric Loss of Toner]

The dielectric loss of toner was measured with a dielectric loss measuring apparatus (product name: model TR-10C manufactured by Ando Electric Co., Ltd), and was obtained based on Equation (3) above from the measurement values. Model WBG-9 (product name, manufactured by Ando Electric Co., Ltd) was used as an oscillator; model BDA-9 (product name, manufactured by Ando Electric Co., Ltd) was used as a apparatus for detecting a equilibrium point; model TO-19 (product name, manufactured by Ando Electric Co., Ltd) was used as a constant temperature bath; and model SE-70 (product name, manufactured by Ando Electric Co., Ltd) was used as an electrode for solid.

Test Example 1

In Test Example 1, the effect of the dielectric loss (tan δ) of the toner and the content (wt %) of the acrylic resin in the coating layer of the carrier on the performance of the developer was examined, using the thus produced two-component developers of Examples 1 to 9 and Comparative Examples 1 to 12.

Example 1

[Production of Toner]

10 kg of raw material that was weighed at a proportion of 40 parts by weight of carbon black (product name: #44, particle diameter: 24 nm manufactured by Mitsubishi Chemical Co., Ltd) with respect to 60 parts by weight of polyester resin (product name: EP208, manufactured by Sanyo Chemical Industries Ltd.) was mixed for 3 minutes at 700 rotation of the agitating blade per minute (700 rpm) with HENSCHEL MIXER. The obtained raw material mixture was supplied in a predetermined amount to a continuous two-roller type kneader as shown in FIGS. 1A and 1B with a table feeder and was melted and kneaded and thus a kneaded product was obtained. This kneaded product was cooled, and then roughly ground in a hummer type grinder, using a screen having a pore diameter of 2 mm, and thus a kneaded and roughly ground product was obtained.

The running conditions of the continuous two-roll type are as follows:

Roll diameter: 0.12 m

Effective roll length: 0.8 m

Rotation speed of the first kneading roll: 75 rotations per minute (75 rpm)

Rotation speed of the second kneading roll: 55 rotations per minute (55 rpm)

Rotation speed of the second kneading roll/Rotation speed of the first kneading roll: about 0.7

Gap between the first kneading roll and the second kneading roll: 0.1 mm

Temperature of heating and cooling medium in the rolls:

first kneading roll raw material mixture inlet side; 90° C., kneaded product outlet side; 75° C.

second kneading roll raw material mixture inlet side; 15° C., kneaded product outlet side; 15° C.

Residence time of the raw material mixture: about 6 minutes

First, 10 kg of raw material that was weighed at a proportion of 25 parts by weight of the above obtained kneaded and roughly ground product, 4 parts by weight of charge control agent (product name: BONTRON S-34 manufactured by Orient Chemical Industries, Ltd) and 5 parts by weight of polyolefin wax (product name: HIGH WAX NP105, a melting point of 148° C., manufactured by Mitsui Chemical Co., Ltd.) as a parting agent with respect to 66 parts by weight of polyester resin (product name: EP208, manufactured by Sanyo Chemical Industries Ltd.) was mixed for 2 minutes at 850 rotation of the agitating blade per minute (850 rpm) with HENSCHEL MIXER, and thus a raw material mixture was obtained.

The obtained raw material mixture was melted and kneaded with an extrusion kneader (product name: PCM-30, manufactured by Ikegai Iron Works, Ltd.). The running conditions of the extrusion kneader are such that the cylinder setting temperature was 110° C., the barrel rotation speed was 380 rpm, and the raw material mixture supply speed was 10 kg/hour. The obtained kneaded product was cooled for one hour with a cooling belt having a surface temperature of 15° C., and then was roughly ground in a speed mill having a screen with a pore diameter (ϕ) of 2 mm. The obtained roughly-ground product was ground in a I type jet mill and then was classified with an Elbow-Jet classifier so that a toner having a volume average particle diameter (D50) of 6.7 μm was produced. The dielectric loss (tan δ) of the obtained toner was $4.2\times10^{-3}$.

[Production of Carrier]

First, 5 parts by weight of acrylic resin (product name: HITALOID 3019 manufactured by Hitachi Chemical Co., Ltd) and 5 parts by weight of titanium oxide (product name: ECTT-1 manufactured by TITAN KOGYO KABUSHIKI KAISHA) as the conductive particles were mixed to 90 parts by weight (in terms of solid content) of silicone resin (product name: TSR115 manufactured by TOSHIBA CORPORATION), and the obtained mixture was diluted with toluene to prepare a coating resin solution having a solid content of 10% by weight. Mn-Mg ferrite particles (product name: EF CARRIER having a volume average particle diameter of 60 μm manufactured by Powder Tech Corporation) were used as the carrier core material, and the obtained coating resin solution was sprayed to the carrier core material by a fluidized bed method while adjusting the ratio of the coating layer after firing so as to be a value described below, and then baked by heating at 200° C. for 2 hours so that a carrier containing 20 parts by weight of the coating layer with respect to 100 parts by weight of the carrier core material was produced. The weight average particle (D50) of the obtained carrier was 60 μm.

[Production of Two-component Developer]

The two-component developer of the invention was produced by mixing the above obtained toner and carrier uniformly by a Nauter mixer at such a ratio that the concentration of the toner in the two-component developer was 4.0% by weight.

Example 2

The two-component developer of Example 2 was produced in the same manner as Example 1, except that when producing the carrier, the mixing amount of the silicone resin was changed to 65 parts by weight, and that the mixing amount of the acrylic resin was changed to 30 parts by weight.

Example 3

The two-component developer of Example 3 was produced in the same manner as Example 1, except that when producing the carrier, the mixing amount of the silicone resin was changed to 45 parts by weight, and that the mixing amount of the acrylic resin was changed to 50 parts by weight.

Examples 4 to 6

The two-component developers of Examples 4 to 6 were produced in the same manner as Examples 1 to 3, respectively, except that when producing the toner, regarding the running conditions of the extrusion kneader, the cylinder setting temperature was changed to 110° C., the barrel rotation speed to 350 rotations per minute (350 rpm), and the raw material mixture supply speed to 15 kg/hour. The dielectric loss (tan δ) of the toners obtained in Examples 4 to 6 was $8.7\times10^{-3}$.

Examples 7 to 9

The two-component developers of Examples 7 to 9 were produced in the same manner as Examples 1 to 3, respectively, except that when producing the toner, regarding the running conditions of the extrusion kneader, the cylinder setting temperature was changed to 120° C., the barrel rotation speed to 300 rotations per minute (300 rpm), and the raw material mixture supply speed to 15 kg/hour. The dielectric loss (tan δ) of the toners obtained in Examples 7 to 9 was $14.7\times10^{-3}$.

Comparative Examples 1 to 3

The two-component developers of Comparative Examples 1 to 3 were produced in the same manner as Examples 1 to 3, respectively, except that when producing the toner, regarding the running conditions of the extrusion kneader, the cylinder setting temperature was changed to 110° C., the barrel rotation speed to 380 rotations per minute (380 rpm), and the raw material mixture supply speed to 8 kg/hour. The dielectric loss (tan δ) of the toners obtained in Comparative Examples 1 to 3 was $2.8\times10^{-3}$.

Comparative Examples 4 to 6

The two-component developers of Comparative Examples 4 to 6 were produced in the same manner as Examples 1 to 3, respectively, except that when producing the toner, regarding the running conditions of the extrusion kneader, the cylinder setting temperature was changed to 140° C., the barrel rotation speed to 150 rotations per minute (150 rpm), and the raw material mixture supply speed to 15 kg/hour. The dielectric loss (tan δ) of the toners obtained in Comparative Examples 4 to 6 was $15.4\times10^{-3}$.

Comparative Example 7

The two-component developer of Comparative Example 7 was produced in the same manner as Example 1, except that when producing the carrier, the mixing amount of the silicone resin was changed to 92 parts by weight, and that the mixing amount of the acrylic resin was changed to 3 parts by weight.

Comparative Example 8

The two-component developer of Comparative Example 8 was produced in the same manner as Example 1, except that when producing the toner, regarding the running conditions of the extrusion kneader, the cylinder setting temperature was changed to 110° C., the barrel rotation speed to 350 rotations per minute (350 rpm), and the raw material mixture supply speed to 15 kg/hour, and that when producing the carrier, the mixing amount of the silicone resin was changed to 92 parts by weight, and that the mixing amount of the acrylic resin was changed to 3 parts by weight. The dielectric loss (tan δ) of the toner obtained in Comparative Example 8 was $8.7\times10^{-3}$.

Comparative Example 9

The two-component developer of Comparative Example 9 was produced in the same manner as Example 1, except that when producing the toner, regarding the running conditions of the extrusion kneader, the cylinder setting temperature was changed to 120° C., the barrel rotation speed to 300 rotations per minute (300 rpm), and the raw material mixture supply speed to 15 kg/hour, and that when producing the carrier, the mixing amount of the silicone resin was changed to 92 parts by weight, and that the mixing amount of the acrylic resin was changed to 3 parts by weight. The dielectric loss (tan δ) of the toner obtained in Comparative Example 9 was $14.7\times10^{-3}$.

Comparative Example 10

The two-component developer of Comparative Example 10 was produced in the same manner as Example 1, except that when producing the carrier, the mixing amount of the silicone resin was changed to 35 parts by weight, and that the mixing amount of the acrylic resin was changed to 60 parts by weight.

Comparative Example 11

The two-component developer of Comparative Example 11 was produced in the same manner as Example 1, except that when producing the toner, regarding the running conditions of the extrusion kneader, the cylinder setting temperature was changed to 110° C., the barrel rotation speed to 350 rotations per minute (350 rpm), and the raw material mixture supply speed to 15 kg/hour, and that when producing the carrier, the mixing amount of the silicone resin was changed to 35 parts by weight, and that the mixing amount of the acrylic resin was changed to 60 parts by weight. The dielectric loss (tan δ) of the toner obtained in Comparative Example 11 was $8.7\times10^{-3}$.

Comparative Example 12

The two-component developer of Comparative Example 12 was produced in the same manner as Example 1, except that when producing the toner, regarding the running conditions of the extrusion kneader, the cylinder setting temperature was changed to 120° C., the barrel rotation speed to 300 rotations per minute (300 rpm), and the raw material mixture supply speed to 15 kg/hour, and that when producing the carrier, the mixing amount of the silicone resin was changed to 35 parts by weight, and that the mixing amount of the acrylic resin was changed to 60 parts by weight. The dielectric loss (tan δ) of the toner obtained in Comparative Example 12 was $14.7\times10^{-3}$.

Table 1 shows the colorant concentration (wt %), the dielectric loss (tan δ) and the volume average particles (D50, μm) of the toner obtained in Examples 1 to 9 and Comparative Examples 1 to 12.

Furthermore, Table 1 shows the ratio (parts by weight) of the coating layer with respect to 100 parts by weight of ferrite particles that constitute the carrier core material, the content (wt %) of the acrylic resin in the coating layer, the content (wt %) of titanium oxide that is conductive particles in the coating layer and the weight average particle diameter (D50, μm) of the carriers obtained in Examples 1 to 9 and Comparative Examples 1 to 12.

Moreover, Table 1 shows the concentration (wt %) of the toner in each two-component developer of Examples 1 to 9 and Comparative Examples 1 to 12.

TABLE 1

| | | toner | | | carrier | | | | |
|---|---|---|---|---|---|---|---|---|---|
| | | | | | ratio of coating | coating layer | | | |
| Developer | | colorant concentration (wt %) | tan δ ($\times10^{-3}$) | D50 (μm) | layer (wt parts) | acrylic resin (wt %) | conductive particles (wt %) | D50 (μm) | toner concentration (wt %) |
| Ex. | 1 | 10 | 4.2 | 6.7 | 20 | 5 | 5.0 | 60 | 4.0 |
| | 2 | 10 | 4.2 | 6.7 | 20 | 30 | 5.0 | 60 | 4.0 |
| | 3 | 10 | 4.2 | 6.7 | 20 | 50 | 5.0 | 60 | 4.0 |
| | 4 | 10 | 8.7 | 6.7 | 20 | 5 | 5.0 | 60 | 4.0 |

TABLE 1-continued

| Developer | | toner | | | carrier | | | | | toner concentration (wt %) |
|---|---|---|---|---|---|---|---|---|---|---|
| | | | | | ratio of coating layer (wt parts) | coating layer | | | | |
| | | colorant concentration (wt %) | tan δ ($\times 10^{-3}$) | D50 (μm) | | acrylic resin (wt %) | conductive particles (wt %) | D50 (μm) | | |
| | 5 | 10 | 8.7 | 6.7 | 20 | 30 | 5.0 | 60 | | 4.0 |
| | 6 | 10 | 8.7 | 6.7 | 20 | 50 | 5.0 | 60 | | 4.0 |
| | 7 | 10 | 14.7 | 6.7 | 20 | 5 | 5.0 | 60 | | 4.0 |
| | 8 | 10 | 14.7 | 6.7 | 20 | 30 | 5.0 | 60 | | 4.0 |
| | 9 | 10 | 14.7 | 6.7 | 20 | 50 | 5.0 | 60 | | 4.0 |
| Com. | 1 | 10 | 2.8 | 6.7 | 20 | 5 | 5.0 | 60 | | 4.0 |
| Ex. | 2 | 10 | 2.8 | 6.7 | 20 | 30 | 5.0 | 60 | | 4.0 |
| | 3 | 10 | 2.8 | 6.7 | 20 | 50 | 5.0 | 60 | | 4.0 |
| | 4 | 10 | 15.4 | 6.7 | 20 | 5 | 5.0 | 60 | | 4.0 |
| | 5 | 10 | 15.4 | 6.7 | 20 | 30 | 5.0 | 60 | | 4.0 |
| | 6 | 10 | 15.4 | 6.7 | 20 | 50 | 5.0 | 60 | | 4.0 |
| | 7 | 10 | 4.2 | 6.7 | 20 | 3 | 5.0 | 60 | | 4.0 |
| | 8 | 10 | 8.7 | 6.7 | 20 | 3 | 5.0 | 60 | | 4.0 |
| | 9 | 10 | 14.7 | 6.7 | 20 | 3 | 5.0 | 60 | | 4.0 |
| | 10 | 10 | 4.2 | 6.7 | 20 | 60 | 5.0 | 60 | | 4.0 |
| | 11 | 10 | 8.7 | 6.7 | 20 | 60 | 5.0 | 60 | | 4.0 |
| | 12 | 10 | 14.7 | 6.7 | 20 | 60 | 5.0 | 60 | | 4.0 |

[Evaluation 1]

Each of the two-component developers of Examples 1 to 9 and Comparative Examples 1 to 12 was fed into the developer-containing container of an image forming apparatus, and a document with text of A4 size that is defined in JIS P0138 with a print ratio of 6% is copied successively in 1000 recording sheets. Then, (a) degree of reduction of hot offset occurrence temperature, (b) image density, (c) degree of image fogging, and (d) degree of toner scattering were evaluated in the following manner. The operation of forming an image is performed at a temperature of 23° C. and a relative humidity of 60%, using a commercially available digital copier (product name: AR-260 manufactured by Sharp Corporation) with a definition of 600 dpi (dot per inch) that is provided with a photosensitive member having an outer diameter of 30 mm as the image forming apparatus, setting the rotational circumferential speed (process speed) of the photosensitive member to 130 mm/sec. For recording sheets, A4-sized sheets (regular paper, a weight of 80 g/m$^2$) were used.

(a) Degree of Reduction of Hot Offset Occurrence Temperature

After continuously copying 1000 sheets, the fixing apparatus was removed from the copier AR-260, and with this copier, a sample image including a 3 cm×3 cm square solid portion was formed in an unfixed state on a recording sheet while adjusting the amount of toner that was attached to the solid portion to 0.60 mg/cm$^2$. The formed unfixed image was fixed under the conditions that the nip width of the fixing rollers was 5 mm, and the rotational circumferential speed of the fixing rollers was 130 mm/sec, using a fixing tester provided with rollers coated with Teflon (registered trademark) as the fixing rollers, and then it was determined through visual observation whether or not the surfaces of the fixing rollers of the fixing tester were greased.

This operation was performed repeatedly while increasing gradually the temperature of the surface of the fixing rollers, and the temperature of the surface of the fixing rollers when greasing started to occur on the surface of the fixing rollers was obtained and this was taken as the hot offset occurrence temperature Tmax. The lower limit specification of the hot offset occurrence temperature of the commercially available digital copier AR-260 used for image formation, which was 220° C., was taken as the reference value T0, and the value (T0−Tmax) obtained by subtracting the obtained hot offset occurrence temperature Tmax from the temperature T0 was obtained as an offset occurrence temperature reduction width ΔT. Using this value as the evaluation index, the degree of reduction in the hot offset occurrence temperature was evaluated. The evaluation criteria of the degree of reduction in the hot offset occurrence temperature are as follows.

G: Good. ΔT is 10° C. or less.

S: No problem in practical use. ΔT is 10° C. or more and less than 30° C.

P: Poor. ΔT is 30° C. or more.

(b) Image Density

After continuously copying 1000 sheets, using the copier AR-260, a sample image including a 3 cm×3 cm solid portion was formed on a recording sheet while adjusting the amount of toner that was attached to the solid portion to 0.60 mg/cm$^2$, and this image was used as an image for evaluation. Using a reflection densitometer (product name: RD918 manufactured by GretagMcbeth), the reflection density of the solid portion of the image for evaluation was measured to evaluate the image density. The evaluation criteria for image density are as follows.

VG: Very good. The image density is 1.35 or more.

G: Good. The image density is 1.30 or more and 1.35 or less.

S: No problem in practical use. The image density is 1.28 or more and 1.30 or less.

P: Poor. The image density is 1.28 or less.

(c) Degree of Image Fogging

Before forming an image on a recording sheet, the degree of whiteness defined by JIS P8148 of a recording sheet was measured in advance at a position that would become a blank portion after image formation, using a whiteness checker (product name: Σ90 manufactured by Nippon Denshoku Industries Co., Ltd.), and this was taken as a first measured value M1. Then, after continuously copying 1000 sheets, using the copier AR-260, an A4-sized document with text with a printing ratio of 6% was copied to form an image on the recording sheet, and this image was used as an image for evaluation. Using the whiteness checker, the degree of whiteness of the blank portion of the image for evaluation was measured at the same position as before image formation, and this was taken as a second measured value M2. Then a fogging density ΔM (M1−M2) was obtained by subtracting the second measured value M2 from the first measured value M1, and using this as the evaluation index, the fogging degree was evaluated. The evaluation criteria for fogging degree are as follows.

VG: Very good. ΔM is 0.70 or less.

G: Good. ΔM is 0.70 or more and 1.00 or less.

S: No problem in practical use. ΔM is 1.00 or more and 1.20 or less.

P: Poor. ΔM is 1.20 or more.

(d) Degree of Toner Scattering

After continuously copying 1000 sheets, the inside of the developing apparatus and the peripheral portion of the developing apparatus of the copier AR-260 were visually observed, and the degree of toner scattering was evaluated. The evaluation criteria for toner scattering degree are as follows.

VG: Very good. There was no toner scattering in the inside or the peripheral portion of the developing apparatus.

G: Good. Toner scattering was observed in the inside, but there was no toner scattering in the peripheral portion of the developing apparatus.

S: No problem in practical use. Toner scattering was observed both in the inside and the peripheral portion of the developing apparatus, but the degree was in the range that causes no problem in practical use.

P: Poor. There was significant toner scattering both in the inside and the peripheral portion of the developing apparatus.

Table 2 shows the evaluation results.

TABLE 2

| | | Hot offset | | | image density | | fogging degree | | toner scattering |
|---|---|---|---|---|---|---|---|---|---|
| developer | | Tmax (° C.) | ΔT (° C.) | evaluation | measured value | evaluation | ΔM | evaluation | evaluation |
| Ex. | 1 | 210 | 10 | G | 1.31 | G | 0.34 | VG | VG |
| | 2 | 220 | 0 | G | 1.33 | G | 0.39 | VG | VG |
| | 3 | 220 | 0 | G | 1.34 | G | 0.45 | VG | VG |
| | 4 | 210 | 10 | G | 1.36 | VG | 0.48 | VG | VG |
| | 5 | 220 | 0 | G | 1.37 | VG | 0.53 | VG | VG |
| | 6 | 220 | 0 | G | 1.41 | VG | 0.61 | VG | VG |
| | 7 | 210 | 10 | G | 1.43 | VG | 0.77 | G | VG |
| | 8 | 220 | 0 | G | 1.45 | VG | 0.86 | G | VG |
| | 9 | 220 | 0 | G | 1.45 | VG | 0.99 | G | G |
| Com. | 1 | 210 | 10 | G | 1.20 | P | 0.31 | VG | VG |
| Ex. | 2 | 220 | 0 | G | 1.25 | P | 0.34 | VG | VG |
| | 3 | 220 | 0 | G | 1.28 | P | 0.34 | VG | VG |
| | 4 | 210 | 10 | G | 1.44 | VG | 1.45 | P | G |
| | 5 | 210 | 10 | G | 1.46 | VG | 1.71 | P | P |
| | 6 | 210 | 10 | G | 1.47 | VG | 2.03 | P | P |
| | 7 | 190 | 30 | P | 1.20 | P | 0.28 | VG | VG |
| | 8 | 190 | 30 | P | 1.26 | P | 0.28 | VG | VG |
| | 9 | 180 | 40 | P | 1.33 | G | 0.46 | VG | VG |
| | 10 | 210 | 10 | G | 1.45 | VG | 1.31 | P | P |
| | 11 | 210 | 10 | G | 1.47 | VG | 1.55 | P | P |
| | 12 | 210 | 10 | G | 1.48 | VG | 1.79 | P | P |

Table 2 shows that when the content of the acrylic resin in the coating layer of the carrier is 5 to 50% by weight, which is in the range defined by the invention, and the dielectric loss (tan δ) of the toner is $4.0\times10^{-3}$ to $15.0\times10^{-3}$ (i.e., $4.0\times10^{-3} \leqq (\tan\delta) \leqq 15.0\times10^{-3}$), which is in the range defined by the invention, then the reduction of the hot offset occurrence temperature after forming images repeatedly can be suppressed and image fogging and toner scattering can be reduced, and thus high quality images having sufficient image density can be obtained.

Test Example 2

In Test Example 2, using the two-component developer of Example 5 and the two-component developer of Example 10 produced in the following manner, the effect of the conductive particles contained in the coating layer of the carrier on the developer performance was examined.

Example 10

The two-component developer of Example 10 was produced in the same manner as Example 5, except that when producing the carrier, the mixing amount of the silicone resin was changed to 95 parts by weight (in terms of solid content), and that titanium oxide, which is constituted by conductive particles, was not used.

Table 3 shows the colorant concentration (wt %), the dielectric loss (tan δ) and the volume average particle diameter (D50, μm) of the toner obtained in Example 10. Table 3 also shows the ratio (parts by weight) of the coating layer with respect to 100 parts by weight of ferrite particles that are the carrier core material, the content (wt %) of the acrylic resin in the coating layer, whether or not titanium oxide that is conductive particles in the coating layer is present and the weight average particle diameter (D50, μm) of the carrier obtained in Example 10. Table 3 also shows the concentration (wt %) in the two-component developer of Example 10. Table 3 also shows the values of the two-component developer of Example 5.

TABLE 3

| | toner | | | carrier | | | | |
|---|---|---|---|---|---|---|---|---|
| | | | | ratio of coating | coating layer | | | |
| Developer | colorant concentration (wt %) | tan δ ($\times 10^{-3}$) | D50 (μm) | layer (wt parts) | acrylic resin (wt %) | conductive particles (wt %) | D50 (μm) | toner concentration (wt %) |
| Ex. 5 | 10 | 8.7 | 6.7 | 20 | 30 | 5.0 | 60 | 4.0 |
| Ex. 10 | 10 | 8.7 | 6.7 | 20 | 30 | absence | 60 | 4.0 |

[Evaluation 2]

Using the two-component developers of Examples 5 and 10, the operation of forming an image on the recording sheet was repeatedly performed and durability was evaluated in the following manner. The image forming operation was performed at a temperature of 23° C. and a relative humidity of 60%, using the commercially available digital copier AR-260 (manufactured by Sharp Corporation) as the image forming apparatus, setting the rotational circumferential speed (process speed) of the photosensitive member to 130 mm/sec. For recording sheets, A4-sized sheets (regular paper, a weight of 80 g/m$^2$) were used.

An A4-sized document with text with a printing ratio of 6% was copied on a recording sheet, and this image was used as an image for evaluation. Regarding the obtained image for evaluation, the image density and the fogging degree of the image were evaluated in the same manner as in Evaluation 1 of Test Example 1. The two-component developer was collected from the developing sleeve of the image forming apparatus, and the concentration and the charge amount of the toner in this two-component developer were measured. The evaluation results obtained above were taken as the initial evaluation results.

After continuously copying an A4-sized document with text with a printing ratio of 6% on 5000 recording sheets, the A4-sized document with text with a printing ratio of 6% was further copied on a recording sheet, and using this image as an image for evaluation, the image density and the fogging degree of the image were evaluated in the same manner as the initial evaluation. The two-component developer was collected from the developing sleeve of the image forming apparatus, and the concentration and the charge amount of the toner in this two-component developer were measured. The evaluation results obtained above were taken as the evaluation results after 5000 copies.

After continuously copying an A4-sized document with text with a printing ratio of 6% on 10000 recording sheets, the image density and the fogging degree of the image were evaluated in the same manner as after 5000 copies, and further the concentration and the charge amount of the toner in the two-component developer collected from the developing sleeve were measured. The evaluation results obtained above were taken as the evaluation results after 10000 copies.

Table 4 shows these evaluation results.

TABLE 4

| | toner concentration (wt %) | | toner charge amount (μC/g) | | image density | | | | fogging degree | | | |
|---|---|---|---|---|---|---|---|---|---|---|---|---|
| | | | | | Ex. 5 | | Ex. 10 | | Ex. 5 | | Ex. 10 | |
| | Ex. 5 | Ex. 10 | Ex. 5 | Ex. 10 | measured value | evaluation | measured value | evaluation | ΔM | evaluation | ΔM | evaluation |
| initial | 4.0 | 4.0 | 33.5 | 33.0 | 1.38 | VG | 1.39 | VG | 0.49 | VG | 0.55 | VG |
| after 5000 copies | 4.2 | 4.7 | 30.8 | 23.8 | 1.40 | VG | 1.44 | VG | 0.53 | VG | 1.02 | S |
| after 10000 copies | 4.1 | 5.2 | 31.5 | 20.6 | 1.40 | VG | 1.45 | VG | 0.51 | VG | 1.15 | S |

Table 4 shows that when the conductive particles are contained in the coating layer of the carrier, the change in the toner concentration and toner charge amount in the two-component developer supported by the developer holding member is stabilized, and image fogging is further reduced and an image having a sufficient image density can be obtained.

Test Example 3

In Test Example 3, using the two-component developer of Example 5 and the two-component developers of Examples 11 to 13 produced in the following manner, the effect of the ratio of the coating layer in the carrier on the developer performance was examined.

Examples 11 to 13

The two-component developers of Examples 11 to 13 were produced in the same manner as Example 5, except that when producing the carrier, the amount of the coating resin solution sprayed was changed such that the ratio of the coating layer with respect to 100 parts by weight of ferrite particles that are carrier core material was as shown in table 5. Table 5 also shows the values of the two-component developer of Example 5.

TABLE 5

| | toner | | | carrier | | | | |
|---|---|---|---|---|---|---|---|---|
| | | | | ratio of coating | coating layer | | | |
| Developer | colorant concentration (wt %) | tan δ ($\times 10^{-3}$) | D50 (μm) | layer (wt parts) | acrylic resin (wt %) | conductive particles (wt %) | D50 (μm) | toner concentration (wt %) |
| Ex. 5 | 10 | 8.7 | 6.7 | 20 | 30 | 5.0 | 60 | 4.0 |
| Ex. 11 | 10 | 8.7 | 6.7 | 5 | 30 | 5.0 | 60 | 4.0 |
| Ex. 12 | 10 | 8.7 | 6.7 | 2 | 30 | 5.0 | 60 | 4.0 |
| Ex. 13 | 10 | 8.7 | 6.7 | 30 | 30 | 5.0 | 60 | 4.0 |

[Evaluation 3]

Regarding the two-component developers of Example 5 and Examples 11 to 13, the degree of reduction of hot offset occurrence temperature, the image density, the degree of image fogging and the degree of toner scattering were evaluated in the same manner as in Evaluation 1 of Test Example 1. Table 6 shows these evaluation results.

TABLE 6

| | Hot offset | | | image density | | fogging degree | | toner scattering |
|---|---|---|---|---|---|---|---|---|
| developer | Tmax (° C.) | ΔT (° C.) | evaluation | measured value | evaluation | ΔM | evaluation | evaluation |
| Ex. 5 | 210 | 10 | G | 1.37 | VG | 0.53 | VG | VG |
| Ex. 11 | 210 | 10 | G | 1.40 | VG | 0.66 | VG | VG |
| Ex. 12 | 220 | 0 | G | 1.43 | VG | 1.05 | S | S |
| Ex. 13 | 210 | 10 | G | 1.30 | S | 0.38 | VG | VG |

Table 6 shows that when the ratio of the coating layer in the carrier is 5 to 20 parts by weight with respect to 100 parts by weight of the carrier core material, image fogging and toner scattering can be further reduced, and images having higher image density can be obtained.

Test Example 4

In Test Example 4, using the two-component developer of Example 5 and the two-component developers of Examples 14 to 17 produced in the following manner, the effect of the weight average particle diameter of the carrier on the developer performance was examined.

Examples 14 to 17

The two-component developers of Examples 14 to 17 were produced in the same manner as Example 5, except that the volume average particle diameter of the ferrite particles was changed such that the weight average particle diameter of the carrier was as shown in Table 7. Table 7 also shows the values of the two-component developer of Example 5.

TABLE 7

| | toner | | | carrier | | | | |
|---|---|---|---|---|---|---|---|---|
| | | | | ratio of coating | coating layer | | | |
| Developer | colorant concentration (wt %) | tan δ ($\times 10^{-3}$) | D50 (μm) | layer (wt parts) | acrylic resin (wt %) | conductive particles (wt %) | D50 (μm) | toner concentration (wt %) |
| Ex. 5 | 10 | 8.7 | 6.7 | 20 | 30 | 5.0 | 60 | 4.0 |
| Ex. 14 | 10 | 8.7 | 6.7 | 20 | 30 | 5.0 | 50 | 4.0 |
| Ex. 15 | 10 | 8.7 | 6.7 | 20 | 30 | 5.0 | 100 | 4.0 |
| Ex. 16 | 10 | 8.7 | 6.7 | 20 | 30 | 5.0 | 40 | 4.0 |
| Ex. 17 | 10 | 8.7 | 6.7 | 20 | 30 | 5.0 | 110 | 4.0 |

[Evaluation 4]

Regarding the two-component developers of Example 5 and Examples 14 and 17, the degree of reduction of hot offset occurrence temperature, the image density, the degree of image fogging and the degree of toner scattering were evaluated in the same manner as in Evaluation 1 of Test Example 1. Table 8 shows these evaluation results.

TABLE 8

| | hot offset | | | image density | | fogging degree | | toner scattering |
|---|---|---|---|---|---|---|---|---|
| Developer | Tmax (° C.) | ΔT (° C.) | evaluation | measured value | evaluation | ΔM | evaluation | evaluation |
| Ex. 5 | 220 | 0 | G | 1.37 | VG | 0.53 | VG | VG |
| Ex. 14 | 220 | 0 | G | 1.34 | G | 0.39 | VG | VG |
| Ex. 15 | 210 | 10 | G | 1.43 | VG | 0.86 | G | G |
| Ex. 16 | 220 | 0 | G | 1.30 | S | 0.36 | VG | VG |
| Ex. 17 | 210 | 10 | G | 1.45 | VG | 1.15 | S | S |

Table 8 shows that when the weight average particle diameter of the carrier is in the range of 50 to 100 μm, image fogging and toner scattering can be further reduced, and images having higher image density can be obtained.

Test Example 5

In Test Example 5, using the two-component developer of Example 5 and the two-component developers of Examples 18 to 21 produced in the following manner, the effect of the toner concentration in the two-component developer on the developer performance was examined.

Examples 18 to 21

The two-component developers of Examples 18 to 21 were produced in the same manner as Example 5, except that the concentration of the toner in the two-component developer was changed to those values as shown in Table 9. Table 9 also shows the values of the two-component developer of Example 5.

TABLE 9

| | toner | | | carrier | | | | |
|---|---|---|---|---|---|---|---|---|
| | | | | ratio of coating | coating layer | | | |
| Developer | colorant concentration (wt %) | tan δ ($\times 10^{-3}$) | D50 (μm) | layer (wt parts) | acrylic resin (wt %) | conductive particles (wt %) | D50 (μm) | toner concentration (wt %) |
| Ex. 5 | 10 | 8.7 | 6.7 | 20 | 30 | 5.0 | 60 | 4.0 |
| Ex. 18 | 10 | 8.7 | 6.7 | 20 | 30 | 5.0 | 60 | 3.5 |
| Ex. 19 | 10 | 8.7 | 6.7 | 20 | 30 | 5.0 | 60 | 8.0 |
| Ex. 20 | 10 | 8.7 | 6.7 | 20 | 30 | 5.0 | 60 | 3.0 |
| Ex. 21 | 10 | 8.7 | 6.7 | 20 | 30 | 5.0 | 60 | 9.0 |

[Evaluation 5]

Regarding the two-component developers of Example 5 and Examples 18 to 21, the degree of reduction of hot offset occurrence temperature, the image density, the degree of image fogging and the degree of toner scattering were evaluated in the same manner as in Evaluation 1 of Test Example 1. Table 10 shows these evaluation results.

TABLE 10

| | hot offset | | | image density | | fogging degree | | toner scattering |
|---|---|---|---|---|---|---|---|---|
| Developer | Tmax (° C.) | ΔT (° C.) | evaluation | measured value | evaluation | ΔM | evaluation | evaluation |
| Ex. 5 | 220 | 0 | G | 1.37 | VG | 0.53 | VG | VG |
| Ex. 18 | 220 | 0 | G | 1.33 | G | 0.42 | VG | VG |

TABLE 10-continued

| | hot offset | | | image density | | fogging | | toner |
|---|---|---|---|---|---|---|---|---|
| | Tmax | ΔT | | measured | | degree | | scattering |
| Developer | (° C.) | (° C.) | evaluation | value | evaluation | ΔM | evaluation | evaluation |
| Ex. 19 | 220 | 0 | G | 1.44 | VG | 0.69 | VG | G |
| Ex. 20 | 210 | 10 | G | 1.29 | S | 0.35 | VG | VG |
| Ex. 21 | 220 | 0 | G | 1.46 | VG | 1.03 | S | S |

Table 10 shows that when the toner concentration in the two-component developer is in the range of 3.5 to 8.0% by weight, image fogging and toner scattering can be further reduced, and images having higher image density can be obtained.

As described above, when the content of the acrylic resin in the coating layer of the carrier is in the range from 5 to 50% by weight based on the total amount of the coating layer, and the dielectric loss (tan δ) is in the range from $4.0\times10^{-3}$ to $15.0\times10^{-3}$, a two-component developer in which the reduction of the hot offset occurrence temperature due to detachment of the coating layer can be prevented, and image density insufficiency, image fogging and toner scattering can be suppressed can be obtained.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A two-component developer comprising:

a toner containing a binder resin and a colorant; and a carrier having a carrier core material and a coating layer with which the carrier core material is coated, wherein the colorant is selected from the group consisting of a nigrosine dye, a carmine dye, a basic dye, an acidic dye, an oil dye, an anthraquinone dye, a benzidine based yellow organic pigment, a rhodamine based organic pigment, a phthalocyanine based organic pigment, zinc oxide, titanium oxide, furnace black, acetylene black and thermal black, wherein the carrier contains 5 parts by weight or more and 20 parts by weight or less of the coating layer with respect to 100 parts by weight of the carrier core material, and wherein the coating layer of the carrier contains silicone resin and an acrylic resin, said silicone resin being present in the coating layer at 65% by weight and said acrylic resin being present in the coating layer at 30% by weight based on the total amount of the coating layer, said acrylic resin being a copolymer of alicyclic acrylic monomer and at least one acrylic monomer selected from the group consisting of acrylic acids, acrylic esters, dimethyl aminoethyl acrylate, diethyl aminoethyl acrylate, methacrylic acids, methacrylic esters, dimethyl aminoethyl methacrylate, and diethyl aminoethyl methacrylate, and a dielectric loss (tan δ) of the toner is $4.0\times10^{-3}\leqq\tan\delta\leqq15.0\times10^{-3}$.

2. The two-component developer of claim 1, wherein the coating layer of the carrier further comprises conductive particles.

3. The two-component developer of claim 1, wherein the carrier core material is ferrite particles.

4. The two-component developer of claim 1, wherein the carrier has a weight average particle diameter of 50 μm or more and 100 μm or less.

5. The two-component developer of claim 1, wherein the concentration of the colorant in the toner is 10% by weight or more and 15% by weight or less.

6. The two-component developer of claim 1, wherein the concentration of the toner is 3.5% by weight or more and 8.0% by weight or less.

7. A two-component developing apparatus used for developing a latent image formed in a latent image bearing member, comprising:

a developer supplier which includes a developer holding member that is opposed to the latent image bearing member and supports the two-component developer of claim 1 and conveys the developer to a position in which the latent image formed on the latent image bearing member is to be developed; and a processing circuit which controls an operation of the developer supplier such that a moving direction of the developer holding member at a position at which a latent image formed on the latent image bearing member is to be developed is opposite to a moving direction of the latent image bearing member at the position.

* * * * *